US005645022A

United States Patent [19]

Yamamoto et al.

[11] Patent Number: 5,645,022

[45] Date of Patent: Jul. 8, 1997

[54] ENGINE VALVE DRIVE CONTROL DEVICE

[75] Inventors: Toshio Yamamoto; Takaaki Tsukui; Takashi Ichimura; Noriaki Okano, all of Saitama, Japan

[73] Assignee: Honda Giken Kogyo Kabushiki Kaisha, Tokyo, Japan

[21] Appl. No.: 714,293

[22] Filed: Sep. 18, 1996

Related U.S. Application Data

[63] Continuation of Ser. No. 467,832, Jun. 6, 1995, abandoned.

[30] Foreign Application Priority Data

Jun. 6, 1994 [JP] Japan ..... 6-147102

[51] Int. Cl.[6] ..... F01L 13/00

[52] U.S. Cl. ..... 123/90.17; 123/90.6; 123/198 F

[58] Field of Search ..... 123/90.15, 90.17, 123/90.31, 90.6, 198 F

[56] References Cited

U.S. PATENT DOCUMENTS

| | | | |
|---|---|---|---|
| 4,794,893 | 1/1989 | Masuda et al. | 123/90.17 |
| 5,158,049 | 10/1992 | Neumann | 123/90.17 |
| 5,331,866 | 7/1994 | Voight et al. | 123/198 F |

FOREIGN PATENT DOCUMENTS

| | | | |
|---|---|---|---|
| 3732687 | 4/1988 | Germany | 123/90.17 |
| 3920938 | 1/1990 | Germany . | |
| 4419637 | 12/1994 | Germany . | |
| 155514 | 9/1984 | Japan | 123/90.17 |
| 62-150016 | 7/1987 | Japan . | |
| 62-197613 | 9/1987 | Japan . | |
| 63-105216 | 5/1988 | Japan . | |
| 11811 | 1/1990 | Japan | 123/90.17 |
| 3-164509 | 7/1991 | Japan . | |
| 2135390 | 8/1984 | United Kingdom . | |
| 2189548 | 10/1987 | United Kingdom . | |

*Primary Examiner*—Weilun Lo

*Attorney, Agent, or Firm*—Birch, Stewart, Kolasch & Birch, LLP

[57] ABSTRACT

In an engine valve drive control device, a cam lobe is removably engaged with a cam shaft of a valve actuating line of an engine. The cam lobe is rotated, when engaged, together with the cam shaft to drive a valve. Free rotation of the disengaged cam lobe is halted by a cam rotation halting device to leave the valve inactive. The cam lobe is made axially slidable in the axial direction with respect to the cam shaft, and the engagement/disengagement of the cam lobe with/from the cam shaft are switched according to the sliding motion of the cam lobe.

19 Claims, 25 Drawing Sheets

FIG. 17
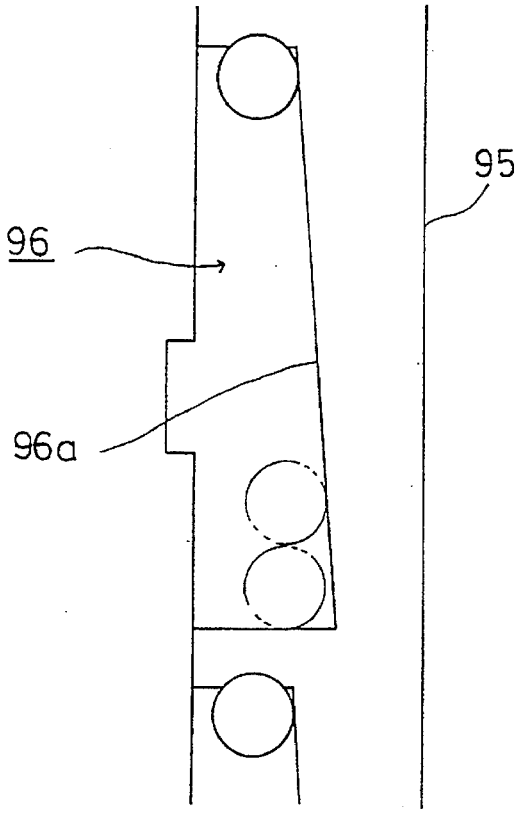
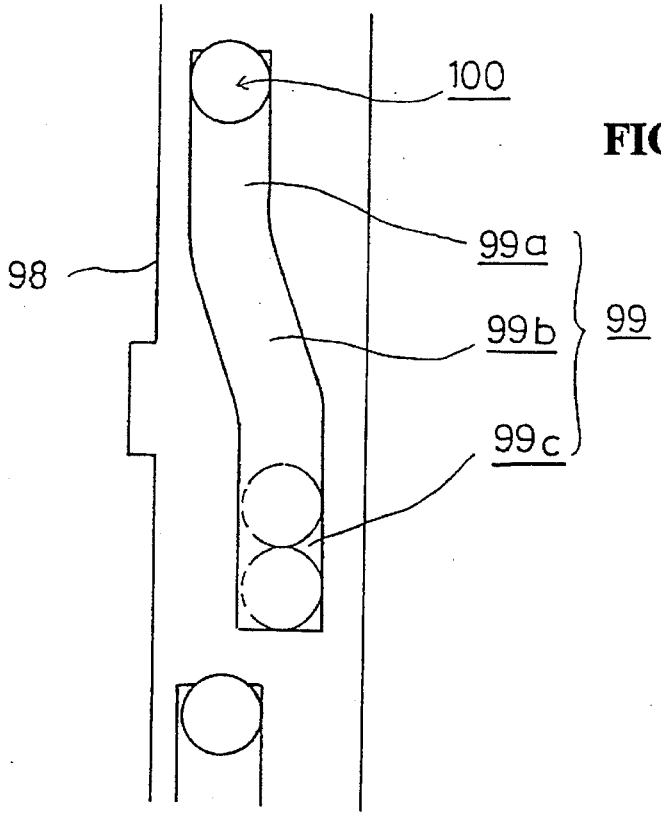
FIG. 18

FIG. 27
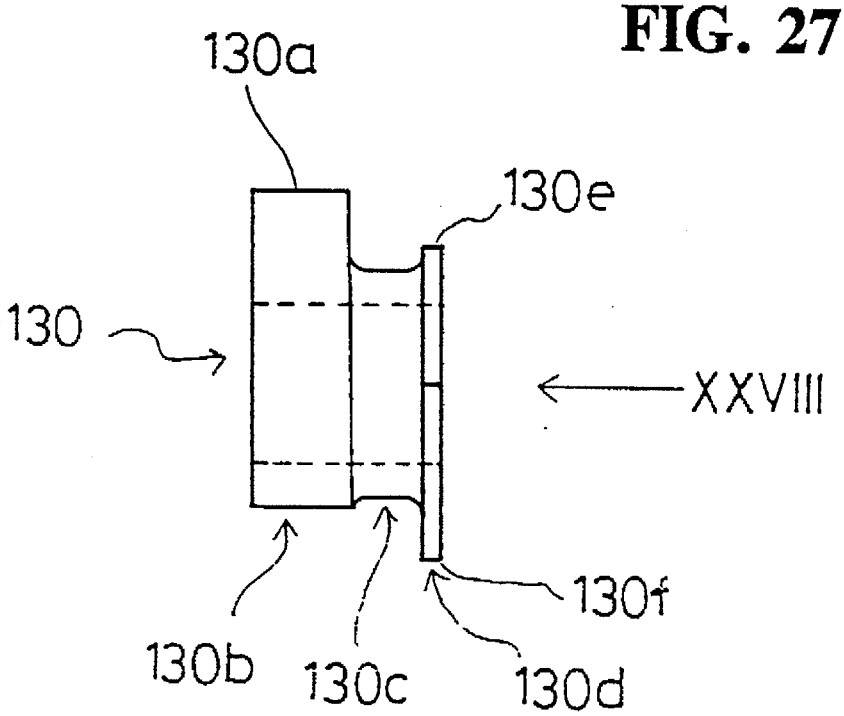
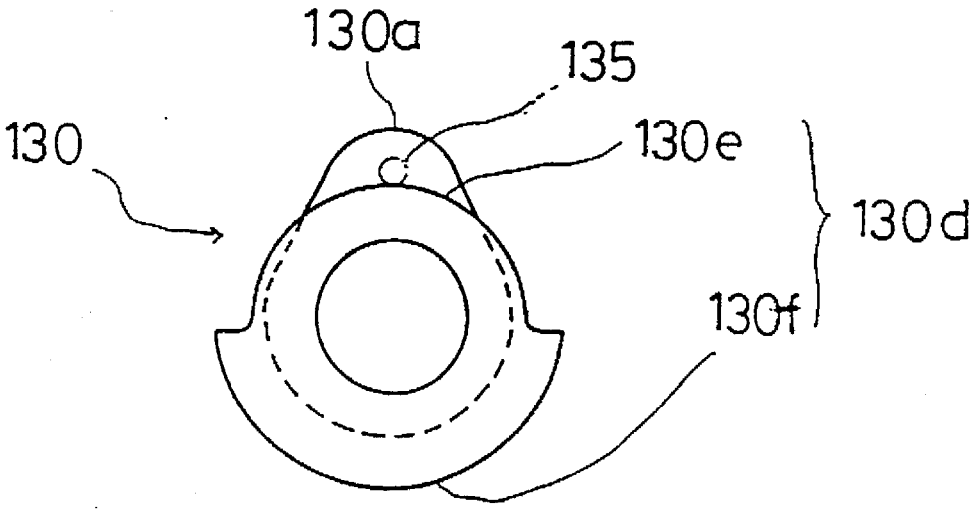
FIG. 28

ENGINE VALVE DRIVE CONTROL DEVICE

This application is a continuation of application Ser. No. 08/467,832 filed on Jun. 6, 1995, now abandoned.

BACKGROUND OF THE INVENTION

1. Field of the Invention

The present invention relates to a valve drive control device in which an intake valve or an exhaust valve of a valve actuating line of an engine is driven by a cam lobe removably engaged with a cam shaft.

2. Description of the Background Art

Such a valve drive control device is exemplified in the prior art by Japanese Patent Laid-Open No. 150016/1987 or 164509/1991, for example. In such a device, the cam shaft of the engine valve actuating line is equipped with a joint pin which can come into and out of the cam shaft from the outer circumference of the same. A rotatable cam lobe fitted in the cam shaft is formed in its inner circumference with a joint hole, into and out of which the joint pin can go. When the joint pin is protruded to enter the joint hole in the inner circumference of the cam lobe, this cam lobe rotates together with the cam shaft to actuate the valve. On the other hand, when the joint pin is extracted from the joint hole, the cam lobe is set free for rotation relative to the cam shaft thereby deactivating the valve.

Immediately thereafter, however, the joint pin comes out of the joint hole to set the cam lobe free for rotation. This cam lobe has a rotational inertial force and may actuate the valve. In the action of the valve at this time for the free rotation, the lift curve is not regulated by the cam shape so that the valve is abruptly seated thereby augmenting the noise and lowering the output.

As disclosed in Japanese Patent 197613/1987, therefore, there is an example of a structure for stopping the cam lobe which is set free for rotation.

In this example, a cylindrical portion integrated with the cam is rotatably interposed between the cam shaft and a support member and is formed with a diametric through hole. The cam shaft and the support member are individually formed with retaining holes which can be opposed to the through hole. A lock plunger (or the joint pin), which is movable in the through hole of the cam cylindrical portion, moves back and forth in the retaining hole of one of the cam shaft and the support member thereby retains one of them.

When the lock plunger to be hydraulically driven is retained by the retaining hole of the cam shaft, the cam rotates together with the cam shaft to activate the valve. On the other hand, when the lock plunger is disengaged from the cam shaft and retained in the retaining hole of the support member, the cam is set free for rotation and comes into engagement with the support member to stop the rotation.

There is another example (as disclosed in Japanese Patent Laid-Open No. 105216/1988), in which the cam is allowed to slide only in the axial direction relative to the cam shaft but is made to rotate together with the cam shaft at all times. A bucket (or the valve lifter) is formed in its portion with a relief so that the cam lobe may be caused to pass around the relief of the valve lifter as the cam slides, to thereby inactivate the valve.

In the case of the former construction (i.e., Japanese Patent Laid-Open No. 197613/1987), however, the lock plunger goes, before being retained, into the retaining hole of one of the cam shafts or the support member. As a result, the protruding timing is restricted to a limited short time period of the cam rotation phase. If poorly timed, the lock plunger fails to completely go into the retaining hole while leaving its portion unretained thereby adversely affecting the valve.

In the latter case (i.e., Japanese Patent Laid-Open No. 105216/1988), on the other hand, the relief formed in the valve lifter is always fixed in a predetermined position but should not shift. As a result, the valve lifter has to be equipped with a rotation preventing structure so that the structure is complicated. This can adversely raise the parts production cost.

SUMMARY AND OBJECTS OF THE INVENTION

The present invention has been conceived in view of the above-specified points and has an object to provide a valve drive control device having a simple structure, which is intended to have no restriction upon the switching timing of the action/inaction of the valve thereby to ensure the switching operation and to improve the activity of the valve.

In order to achieve the aforementioned object, according to the invention, an engine valve drive control device is provided in which a cam lobe removably engaged with a cam shaft of a valve actuating line of an engine. The cam lobe, when engaged, is rotatable together with the cam shaft to drive a valve. Rotation of the cam lobe is halted by cam rotation halting means to leave the valve inactive. The cam lobe is axially slidable in the axial direction with respect to the cam shaft. The engagement/disengagement of the cam lobe with/from the cam shaft being switched according to the sliding motion of the cam lobe.

Since the engagement/disengagement are effected by sliding of the cam lobe in the axial direction relative to the cam shaft, it is possible to improve the activity of the valve and to simplify the structure.

Moreover, the cam lobe is free for rotation relative to the cam shaft as a result of its sliding motion. Rotation by inertial force of this cam lobe is forcibly halted by the cam rotation halting means. Abrupt seating of the valve can therefore be prevented to reduce noise and to prevent a reduction in the output.

According to the invention, the engagement portion formed in the side face of the cam lobe is engaged, as the cam lobe slides, with the engagement portion of a connector integrated with the cam shaft, thereby to ensure the engagement/disengagement between the cam lobe and the cam shaft.

Further according to the invention, disengagement timing adjusting means is provided for disengaging the cam lobe from the connector by temporarily halting sliding of the cam lobe in the disengaging direction from the connector and by releasing the halt at a predetermined timing. As a result, the disengaging timing is set to the predetermined value so that the rotation of the cam lobe can be reliably halted without adversely affecting the action of the valve.

According to the invention, a joint pin is provided to come into and out of the outer circumference of the cam shaft. A cam lobe slider is relatively rotatably fitted on the cam shaft and has a joint hole for receiving/expelling the joint pin. The cam lobe slider rotates when the joint pin comes into the joint hole together with the cam shaft to slide the cam lobe in the axial direction. As a result, the joint pin may be more lightly joined to the cam lobe slider than the cam lobe so that a high strength is not required and can be lightened to increase the action speed while improving engine performance.

Additionally, the cam shaft is equipped with a joint pin for going into and out of the cam shaft from the outer circumference thereof. The cam lobe is formed in its inner circumference with a groove having a predetermined shape. The cam lobe is slid in the axial direction when the joint pin goes out and threads through the groove. As a result, the cam lobe can be slid by a small number of parts.

According to the invention, the cam halting means is equipped with damping means for absorbing the rotational kinetic energy of the cam lobe. As a result, it is possible to prevent noise and to improve durability.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 17 shows an expanded diagram showing a modification of a groove in the inner circumference of the free cam lobe;

FIG. 18 shows an expanded diagram showing another modification of the groove in the inner circumference of the free cam lobe;

FIG. 27 shows a side elevation of the free cam lobe of the same embodiment of FIG. 26;

FIG. 28 shows a diagram taken in the direction of arrow XXVIII of FIG. 27;

PREFERRED EMBODIMENT OF THE INVENTION

Figure 1:
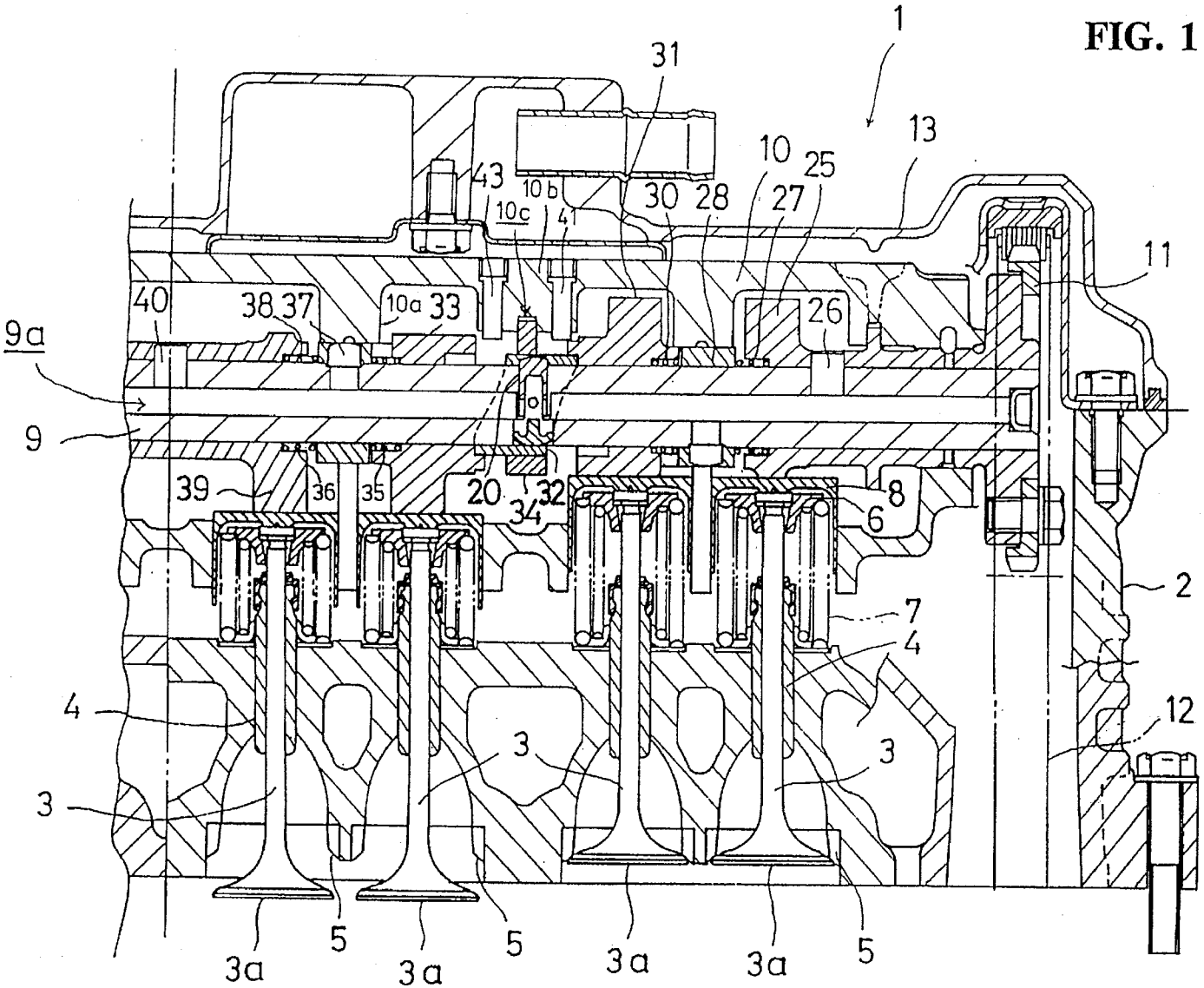
FIG. 1 illustrates an essential portion of the engine of one embodiment according to the present invention.
Figure 2:
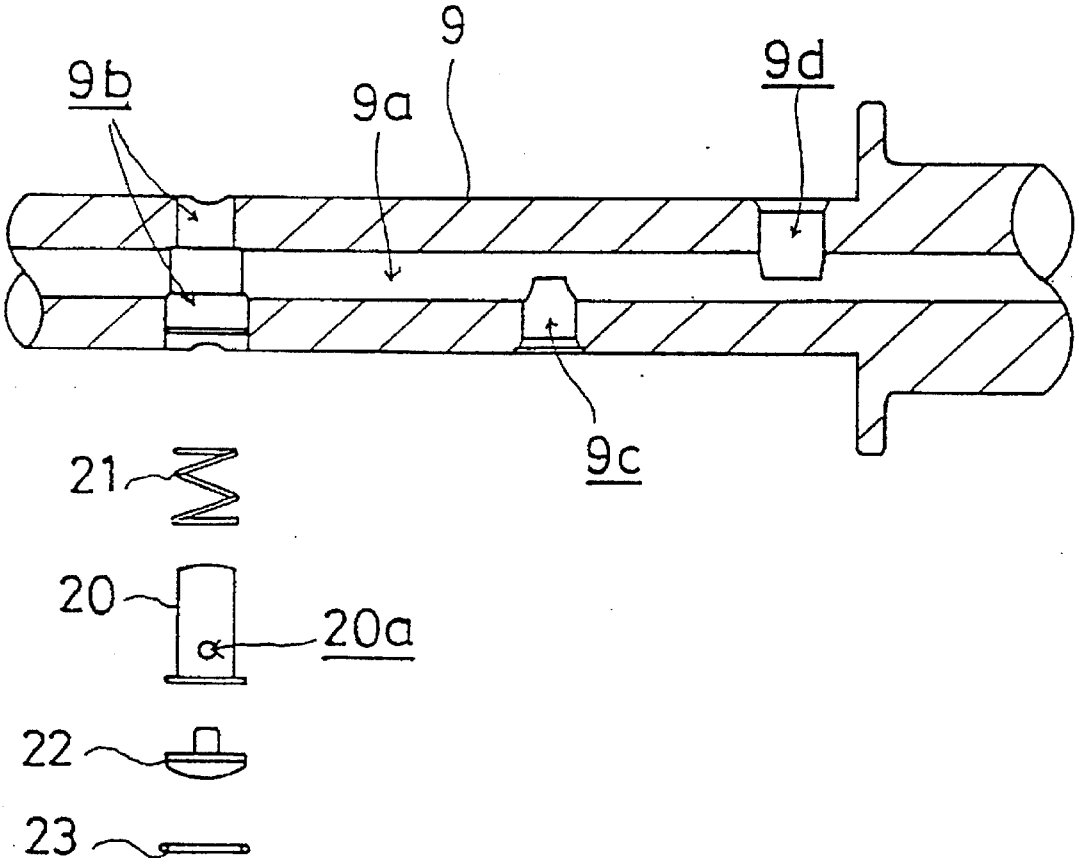
FIG. 2 shows an exploded perspective view of a valve actuating mechanism of the same engine.
Figure 3:
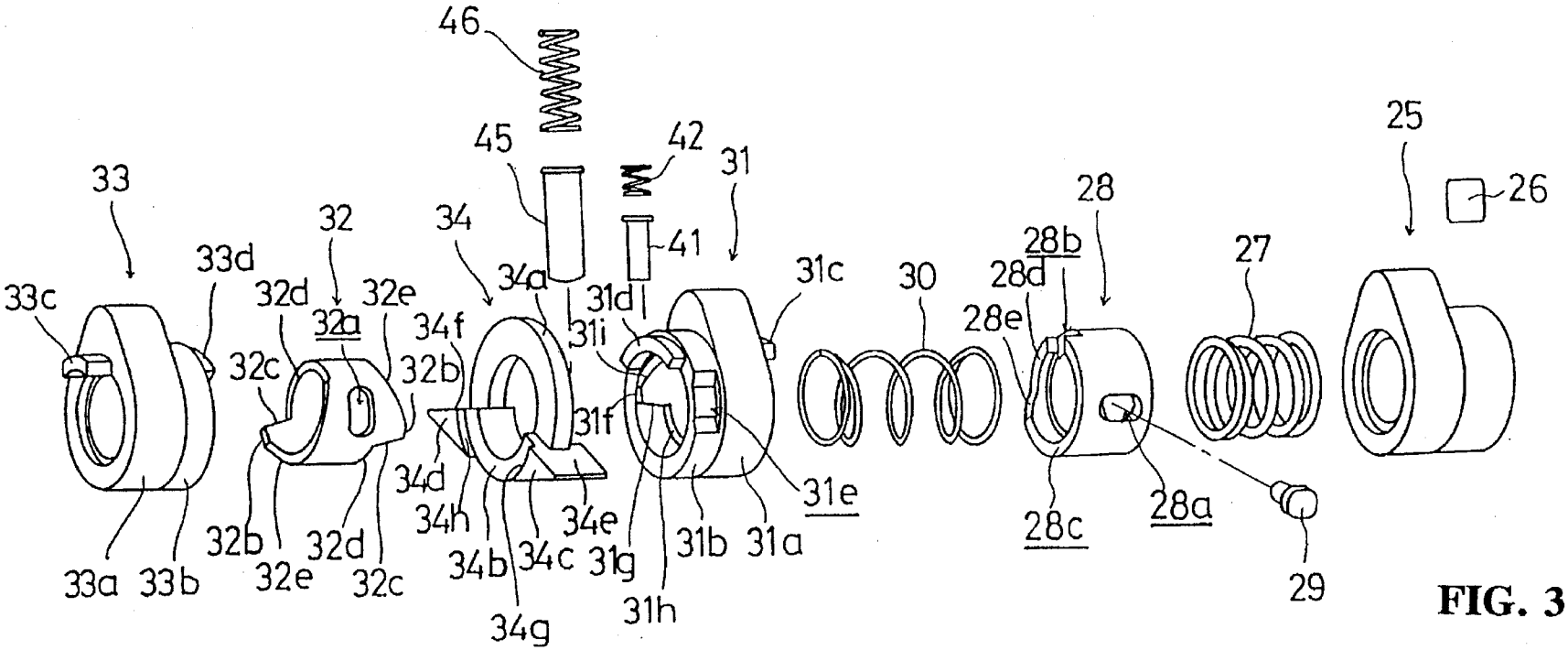
FIG. 3 shows an exploded perspective view of a valve actuating mechanism of another portion.

One embodiment of the present invention will be described with reference to FIGS. 1 to 8 which is applied to a four-cycle four-cylinder engine 1. FIG. 1 is a section of a portion of the engine 1, mainly a valve actuating mechanism and a cylinder head portion. FIGS. 2 and 3 are exploded perspective views of the valve actuating mechanism.

For each cylinder, a cylinder head 2 is arranged with intake and exhaust valves. FIG. 1 shows a structure, in which one valve 3 is slidably supported in each cylinder by two valve guides 4.

The valve 3 has its leading valve member 3*a* adapted to come into abutment against a valve seat 5 and its root end caused to retain one end of a valve spring 7 by a valve spring retainer 6 so that it is urged upwardly. The valve spring retainer 6 is covered with a valve lifter 8.

A cam shaft 9 is located above the valves 3. Cam shaft 9 is supported by bearings at the upper end of the cylinder head 2 and is rotatably held by a cam holder 10, so that the rotation of the crankshaft is transmitted to the cam shaft 9 by a timing chain 12 which is made to run on a sprocket 11 fitted on the end portion of the cam shaft 9 through a rigid cam lobe 25. Incidentally, the cam holder 10 is covered at its top with a head cover 13.

The cam shaft 9 is formed therein with an oil passage 9*a* and further with a through hole 9*b* which crosses the oil passage 9*a*, as shown in FIG. 2, to receive a joint pin 20 and to allow the pin 20 to protrude from the outer circumference of the cam shaft 9. The column-shaped joint pin 20 is fitted in the through hole 9*b* through a return spring 21, and this through hole 9*b* is sealed through a stop pin clip 23 by fitting a sealing plug 22 therein.

The joint pin 20 is formed with a transverse hole 20*a* in communication with an internal small longitudinal hole, so that it can be protruded from the outer circumference of the cam shaft 9 against the return spring 21 by the oil pressure to be fed, when applied to the oil passage 9*a*, through the transverse hole 20*a*. With no oil pressure being applied, however, the joint pin 20 is sunk from the outer circumference of the cam shaft 9 into the inside by the action of the return spring 21. Incidentally, the cam shaft 9 is additionally formed with fitting holes 9*c* and 9*d* for fitting pins.

The valve actuating mechanism to be assembled on the outer circumference of such a cam shaft 9 is exploded and shown in FIG. 3. In FIG. 3, the aforementioned rigid cam lobe 25 is integrated with the right-hand end of the cam shaft 9 by fitting a fixing pin 26. A connector 28 is so fitted on the cam shaft 9 at the left-hand side of the rigid cam lobe 25 through a dowel catch spring 27 by a connect pin 29 that it is allowed to slightly slide in the axial direction.

The connector 28 is allowed to slide slightly in the axial direction by fitting the connect pin 29 into the fitting hole 9*c* of the cam shaft 9 through a slot 28*a* which is formed in the side wall of the cylinder while being slightly elongated in the axial direction. However, the connector 28 rotates integrally with the cam shaft 9.

The connector 28 has its left-hand circumferential end face formed with a dowel joint recess 28*b* and two faces 28*c* and 28*d* which are normal to the axis and merge into each other through a slope 28*e*.

On the left-hand side of the connector 28, a free cam lobe 31 is fitted through a cam lobe slide spring 30. The free cam lobe 31 is allowed to rotate relative to the cam shaft 9 and to slide in the axial direction.

The free cam lobe 31 is formed with a cylindrical portion 31*b* on the left-hand side face of a plate cam portion 31*a* having a lobe. The right-hand side face of the plate cam portion 31*a* bulges to form an arcuate dowel 31*c* to engage with the joint recess 28*b* of the aforementioned connector 28. The left-hand side face of the cylindrical portion 31*b* also bulges to form an arcuate dowel 31*d*.

Both the two dowels 31*c* and 31*d* are formed into arcuate shapes on the axis of rotation and close to the lobe of the plate cam portion 31*a*.

The cylindrical portion 31*b* has its outer circumference formed with a notch 31*e* which is offset by a predetermined angle from the dowel 31*d*. The notch 31*e* merges into the outer circumference through a slope. The inner circumference of the cylindrical portion 31*b* is formed with a notch of a predetermined shape, which has a constant thickness from the right-hand end face. This notch merges from a slightly inclined arcuate short end face 31*f*, which is close to the left-hand circumferential side face of the cylindrical portion 31*b*, through a steep end face 31*g* into the deepest end face 31*h* having a slightly larger arcuate length. This end face 31*h* merges into the aforementioned end face 31*f* through a gently sloped end face 31*i*.

A cylindrical cam lobe slider 32 having an end face opposed to such notches is rotatably fitted on the cam shaft 9, and the aforementioned joint pin 20 is positioned to be fitted in a circumferentially elongated slot 32*a* which is formed in the side wall of the cam lobe slider 32.

Figure 9A:
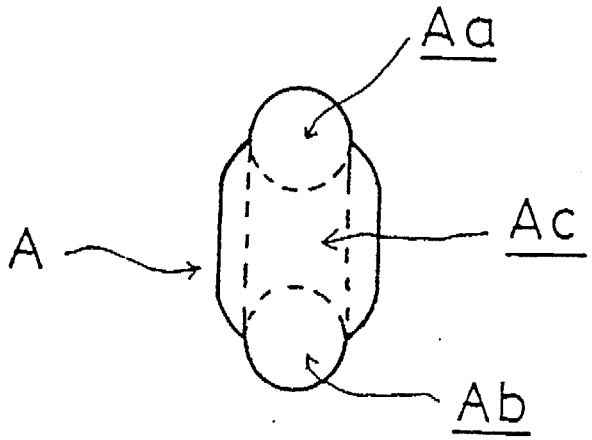
FIG. 9(*a*) and 9(*b*) show a modification of a slot of a cam lobe slider.
Figure 9B:
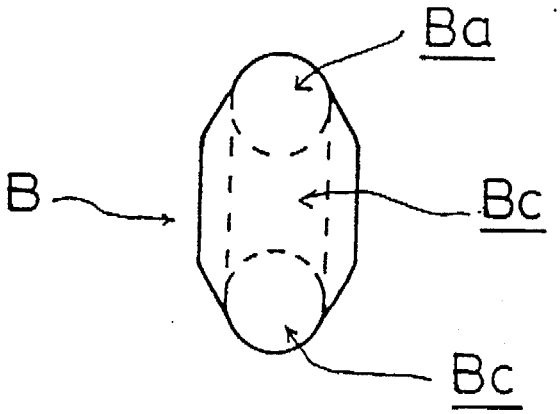

Incidentally, modifications of the slot 32*a* are shown in FIGS. 9(*a*) and 9(*b*).

A slot A, as shown in FIG. 9(*a*), is composed of two end portions Aa and Ab, which are formed of semicircles having an diameter equal to that of the joint pin 20, and a central portion Ac which connects the two semicircles Aa and Ab and has a width larger than the diameter of the joint pin 20.

Since the central portion Ac is made wider than the joint pin 20, this pin 20 can be easily fitted. When the joint pin 20 is brought into the end portion Aa or Ab, it is snugly fitted without any chatter in the semicircle hole having the same diameter.

On the other hand, a slot B, as shown in FIG. 9(*b*), is composed of two end portions, which are formed of arcs having a diameter equal to that of the joint pin 20 but made narrower than the semicircle. These arcs smoothly merge into the side edges of a wider central portion Bc.

As a result, the joint pin 20 can effect its smooth joint.

The cam lobe slider 32 has its two circumferential end faces formed into predetermined shapes, in which the right-hand circumferential end face is opposed to the notched end faces 31*f*, 31*g*, 31*h* and 31*i* of the cylindrical portion 31*b* of the aforementioned free cam lobe 31. An end face 32*b*, which is the most protruded with a slight slope, merges through a steep end face 32*c* into the deepest end face 32*d* having a slightly longer arcuate length. This end face 32*d* merges through a gently sloped end face 32*e* into the aforementioned end face 32*b*.

The other circumferential end face of the cam lobe slider 32 is formed with end faces which have symmetric shapes displaced by 90 degrees in the circumferential direction. At the left-hand side of the end face, there is disposed a free cam lobe 33 which is given the same shape as that of the aforementioned free cam lobe 31 and fitted on the cam shaft 9 with its left-hand and right-hand sides being reversed. In short, the cam lobe slider 32 is sandwiched between the free cam lobes 31 and 33 which are arranged in symmetric positions.

On the outer circumference of that cam lobe slider 32, there is rotatably fitted a free cam catch arm 34 which is generally formed into a ring shape. In the free cam catch arm 34, a ring is formed of a thinner arcuate portion 34*a* having a central angle of 210 degrees and a thicker arcuate portion 34*b* having the remaining central angle of 150 degrees. The thicker arcuate portion 34*b* has its two end portions centrifugally bulging to form arm portions 34*c* and 34*d*.

These arm portions 34*c* and 34*d* are formed with abutment faces 34*e* and 34*f*, in which the end faces of the thicker arcuate portion 34*b* extending from the thinner arcuate portion 34*a* are centrifugally extended and slightly widened. The centripetal faces 34*g* and 34*h* of the widened portions of the arm portions 34*c* and 34*d* are formed into circumferential faces having an internal diameter substantially equal to the external diameter of cylindrical portions 31*b* and 33*b* of the aforementioned left-hand and right-hand free cam lobes 31 and 33.

As a result, when the left-hand and right-hand free cam lobes 31 and 33 come close to the free cam catch arm 34, the side faces and outer circumferential faces of the cylindrical portions 31*b* and 33*b* of the free cam lobes 31 and 33 can come into sliding contact against the side face of the thicker arcuate portion 34*b* and the inner circumferential faces 34*g* and 34*h* of the arm portions. In this sliding contact state, the arcuate dowels 31*d* and 33*d* bulging from the cylindrical portions 31*b* and 33*b* are enabled to come into abutment against the abutment faces 34*e* and 34*f* of the arm portions 34*c* and 34*d* by the angle relative to the free cam catch arm 34.

At the left-hand side of the free cam lobe 33, as shown in FIG. 1, a connector 36 is fitted in the cam shaft 9 through a cam lobe slide spring 35 by a connect pin 37, while being allowed to slightly slide in the axial direction. The connector 36 is formed with a joint recess 36*b* or the like opposed to a dowel 33*c* of the free cam lobe 33. At the left-hand side of the connector 36, a rigid cam lobe 39 is fitted on the cam shaft 9 through a dowel catch spring 38 by a fixing pin 40.

The rigid cam lobe 39 has a symmetric shape and is symmetrically assembled at its left-hand side with the same members as the various members of the aforementioned connector 36 and free cam lobe 33.

Thus, the various members such as the cam lobe are fitted on the cam shaft 9 and are arranged in the predetermined positions above the valves 3 of the cylinder head 2 and held by the cam holder 10. Then, the rigid cam lobe 25, as located at the right-hand end of FIG. 1, and the free cam lobe 31 at the left-hand side of the former actuate the two valves 3 and 3 of the cylinder of the right-hand end. At this time, the rigid cam lobe 25 is fitted on the cam shaft 9 and always rotates together so that the valve 3 is not rested. When the free cam lobe 31 comes close to the connector 28 so that its dowel 31*c* comes into engagement with the joint recess 28*b*, the rotation of the cam shaft 9 is transmitted through the connector 28 to the free cam lobe 31 to actuate the valve 3. When, the free cam lobe 31 is disengaged from the connector 28, however, the rotation of the cam shaft 9 is not transmitted to the free cam lobe 31 to rest or stop the valve 3.

In the next case of the free cam lobe 33 and the rigid cam lobe 39 for actuating the second cylinder from the right-hand, the right free cam lobe 33 rests the valve 3, but the left-hand rigid cam lobe 39 does not rest the valve 3.

Figure 4:
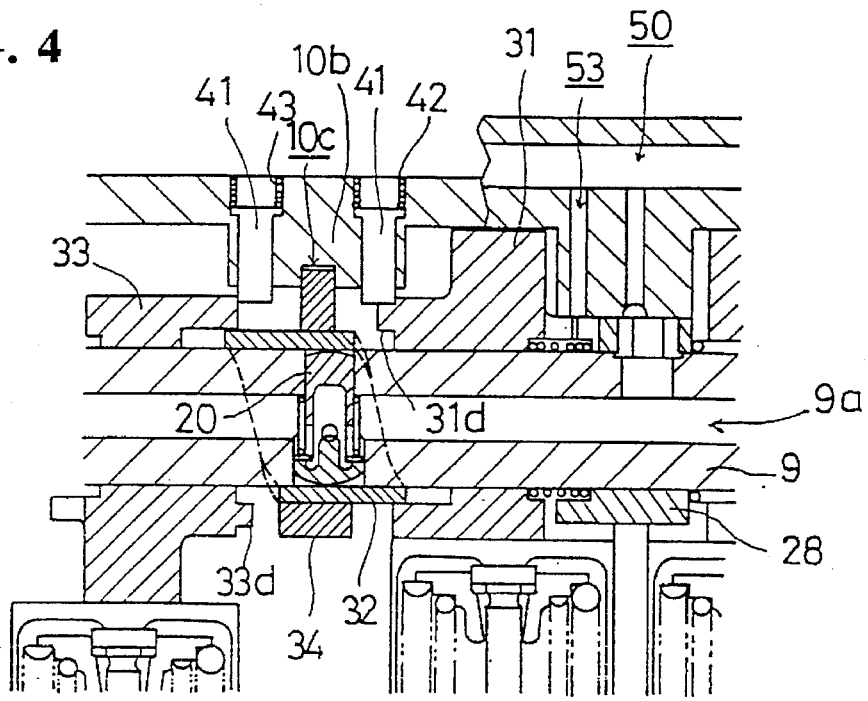
FIG. 4 shows a section of an essential portion of the same engine.

Thus, one valve 3 of the cylinder does not rest whereas the other valve 3 does rest or stop. The cam holder 10 for holding the cam shaft 9 downward is formed with a plurality of protruding bearings 10*a* and a ridge portion 10*b* having an arcuate groove 10*c* for guiding the thinner arcuate portion 34*a* of the aforementioned free cam catch arm 34. Trigger pins 41 and 43 are individually fitted downward in the left-hand and right-hand sides above the ridge portion 10*b* and are held by trigger springs 42 and 44. The trigger pins 41 and 43 have their leading ends partially protruded downward so far that the leading ends are positioned close to the outer circumferences of the arcuate dowels 31*d* and 33*d* bulging from the side faces of the cylindrical portions 31*b* and 33*b* of the free cam lobes 31 and 33. As a result, the leading ends of the trigger pins 41 and 43 can contact with the side faces of the cylindrical portions 31*b* and 33*b* to regulate the axial sliding motions of the free cam lobes 31 and 33 (as shown in FIG. 4).

Incidentally, the leading ends of the trigger pins 41 and 43 can enter the notches 31*e* and 33*e* sideways. These notches 31*e* and 33*e* are formed in the outer circumferences of the cylindrical portions 31*b* and 33*b*. At this time, the free cam lobes 31 and 33 are released from the restrictions of the axial sliding motions. If, in this state, the free cam lobes 31 and 33 rotate, the trigger pins 41 and 43 smoothly slide up along the slopes of the notches 31*e* and 33*e* against the trigger springs 42 and 44 until they come into sliding contact with the outer circumferences.

Figure 6:
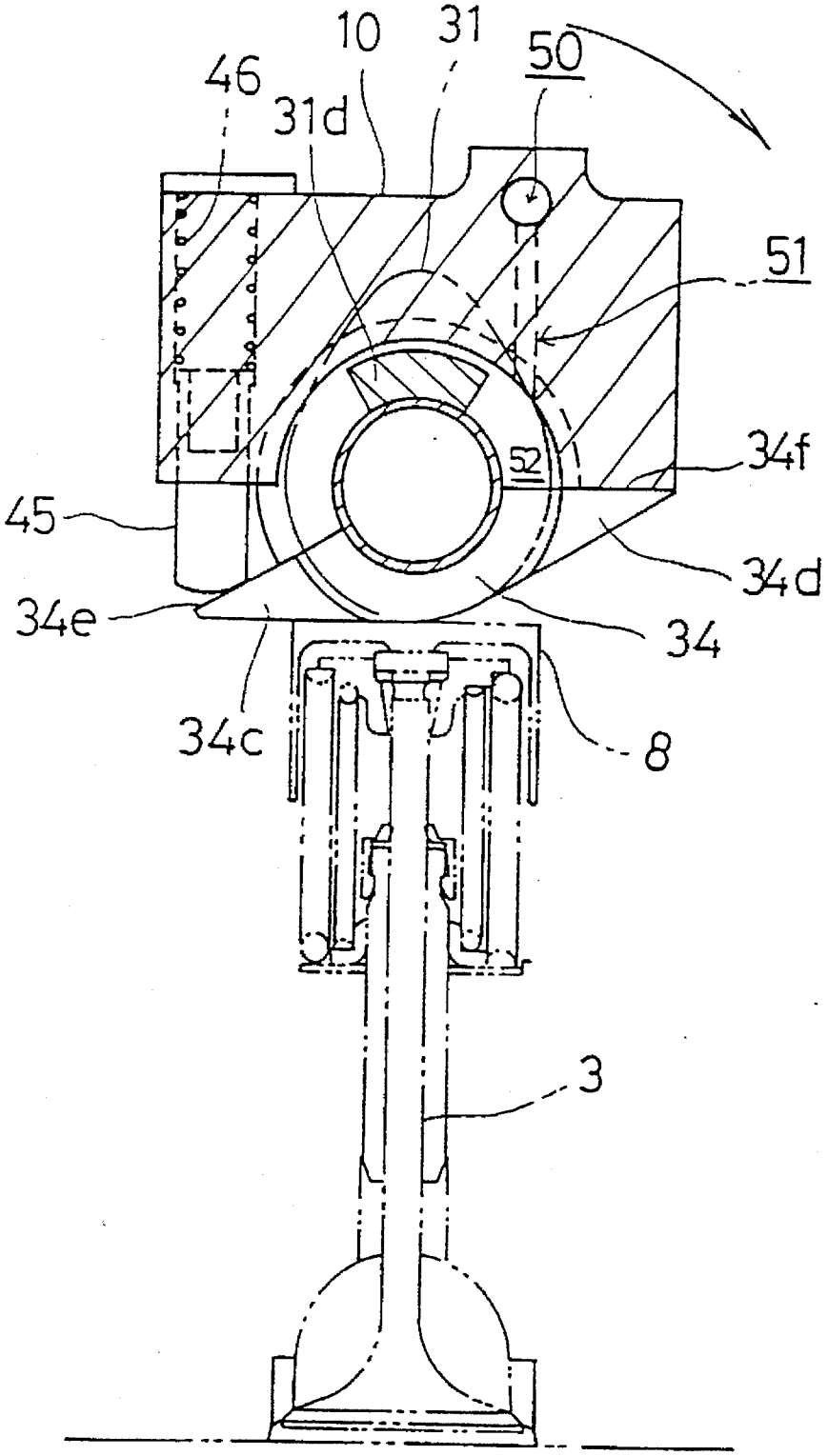
FIG. 6 shows a section taken along line VI-VI of FIG. 5.
Figure 7:
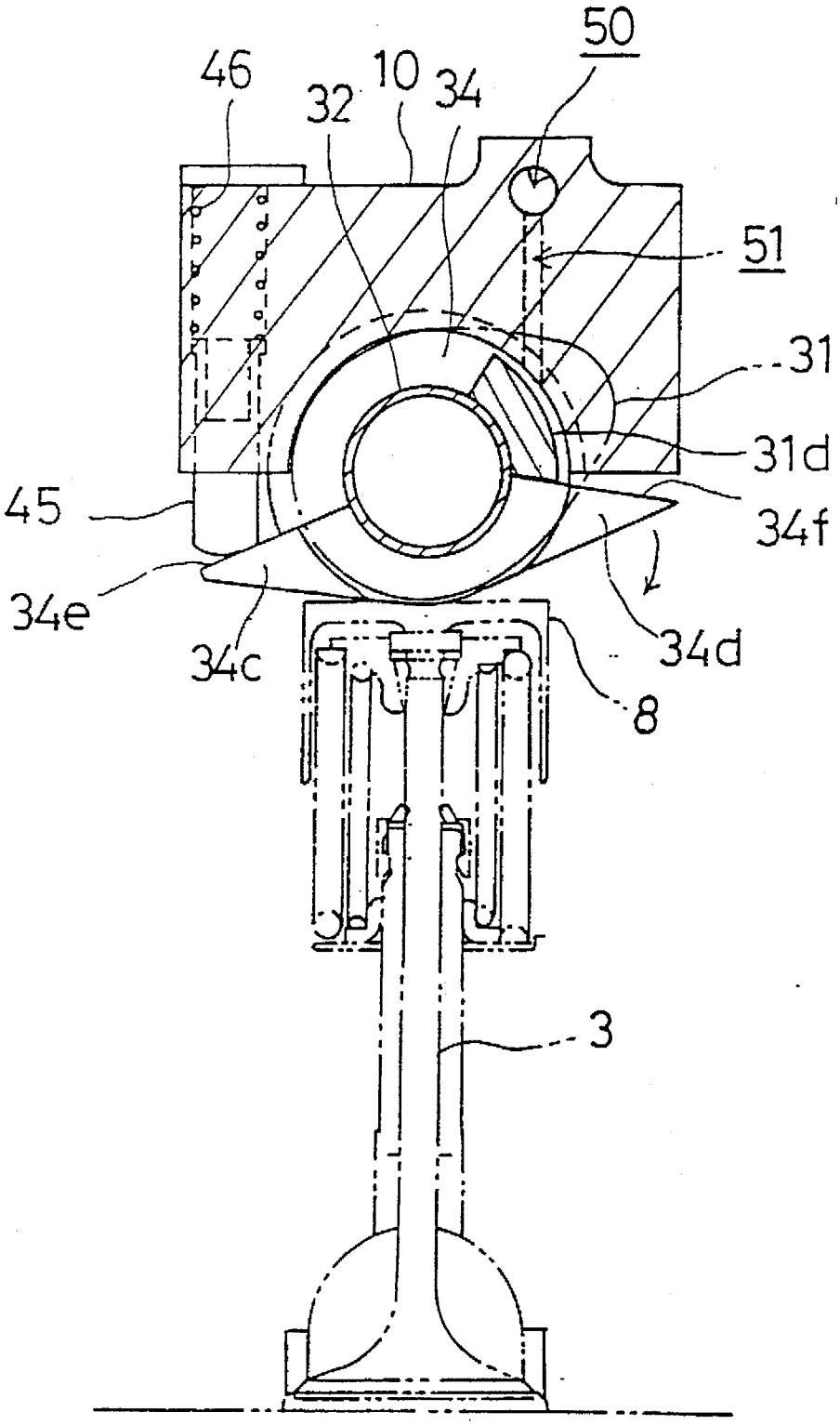
FIG. 7 shows the same section in another state.

In the ridge 10*b* of the cam holder 10, on the other hand, there is fitted a downwardly extending damper pin 45 at the side of the cam shaft 9, as shown in FIGS. 6 and 7. The damper pin 45 is held by a damper spring 46 and has its substantially lower half protruded downward into abutment against the abutment face 34*e* of one arm portion 34*c* of the aforementioned free cam catch arm 34.

In addition, the cam holder 10 has an oil passage 50 which is directed in the axial direction and from which is branched an oil branch to the desired portions of the cam shaft 9. As shown in FIGS. 6 and 7, an oil branch 51 is protruded toward the abutment face 34*f* of the arm 34*d* of the aforementioned free cam catch arm 34 to form an oil reservoir 52 above the abutment face 34*f*.

Figure 5:
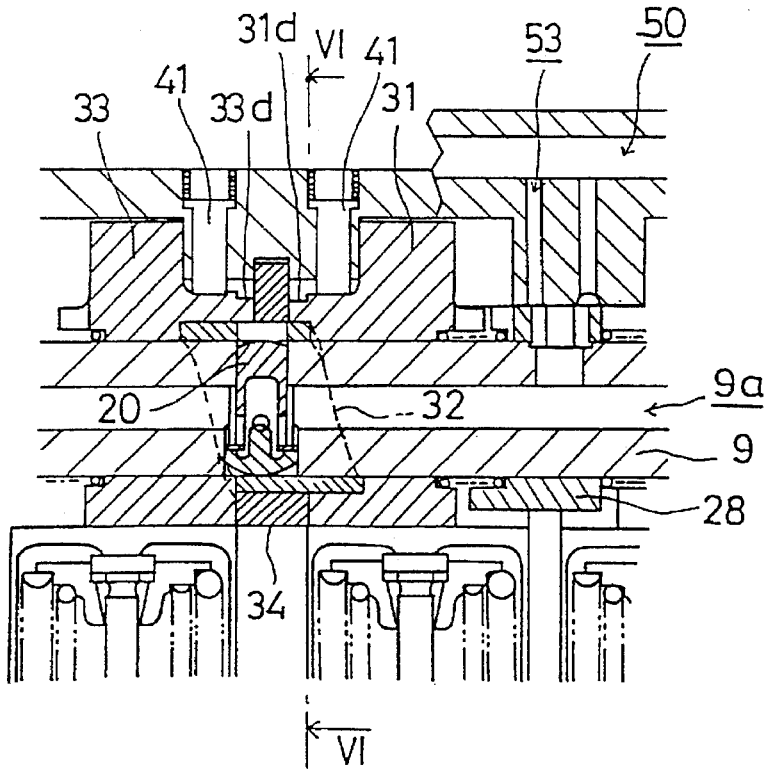
FIG. 5 shows a section of an essential portion of the same engine in another state.

From the oil passage 50, as shown in FIGS. 4 and 5, an oil branch 53 is extended to the joint recess 28*b* of the connector to form the joint recess 28*b* into an oil reservoir.

The valve drive control mechanism of the present embodiment has the structure thus far described, and the operations of the free cam lobes 31 and 33 will be described in the following with reference to the table of FIG. 8.

Figure 8:
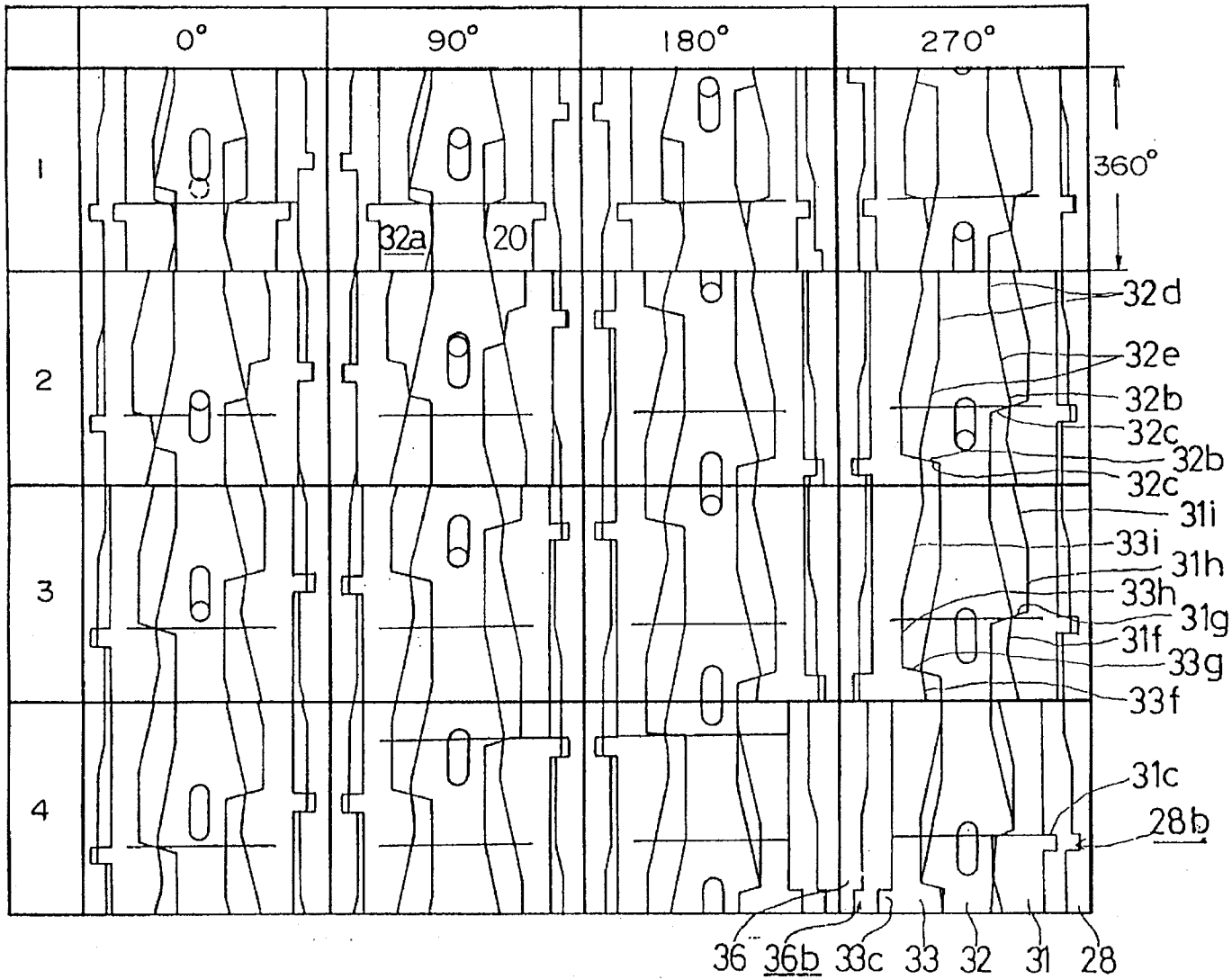
FIG. 8 shows a table shown in an expanded view by arranging the states of the individual members of the valve actuating mechanism in time series.

The table of FIG. 8 arranges the rotating states of the cam shaft 9 at every 90 degrees in time series from the left to the right of each row and shows the rotating states at every 360 degrees from the top to the bottom of each column.

The diagram shown in each section of the table is an expansion, in which the free cam lobes 31 and 33 and the connectors 28 and 36 are arranged at the left-hand and right-hand sides across the cam lobe slider 32. The section indicates 360 degrees from its upper to the lower edges.

The cam shaft 9 moves upward in the table, although not shown, and the joint pin 20 and the left-hand and right-hand connectors 28 and 36 move upward together according to the movement of the cam shaft 9.

First of all, the state of first row and 0 degree in the table indicates that the joint pin 20 is about to protrude from the sunk state, and the left-hand and right-hand free cam lobes 31 and 33 are brought close to the cam lobe slider 32 by the cam lobe slider springs 30 and 35.

When the angle proceeds by 90 degrees, the joint pin 20 is fitted in the slot 32*a* of the cam lobe slider 32 to reach the upper end of the slot 32*a* (at 90 degrees of the first row). Then, the cam lobe slider 32 rotates at first to bring the gently sloped end face 32*e* of its right-hand side into sliding contact with the gently sloped end face 31*i* of the right-hand free cam lobe 31 thereby to slide the free cam lobe 31 to the right. At the next rotation of 90 degrees, the gently sloped end face 32*e* of the left-hand end face of the cam lobe slider 32 comes into sliding contact with the gently sloped end face 31*i* of the left-hand free cam lobe 33 thereby to slide the free cam lobe 33 leftward (at 180 degrees of the first row). During another rotation of 90 degrees, the free cam lobe 31 having slide continues its rightward sliding motion to bring its dowel 31*c* into engagement with the joint recess 28*b* of the connector 28 so that the free cam lobe 31 is rotated together with the connector 28 (at 270 degrees of the first row).

The other free cam lobe 33 continues its leftward sliding motion to bring its dowel 33*c* at a subsequent 90 degrees into engagement with the joint recess 36*b* of the left-hand connector 36 so that the free cam lobe 33 is rotated together with the connector 36 (at 0 degree of the second row).

Thus, the left-hand and right-hand free cam lobes 31 and 33 come into engagement with the connectors 28 and 36 so that the rotation of the cam shaft 9 is transmitted to the free cam lobes 31 and 33. At this time, the cam lobe slider 32 has its leftward and rightward protruding end faces **32*b* and 32*b* brought into contact with the shorter gently sloped end faces 31*f* and 33*f* of the free cam lobes 31 and 33 so that they are clamped from the two sides. From now on, the direction of the sloped end faces 31*f* and 33*f* acts in the direction to advance the cam lobe slider 32, and the dowels 31*c* and 33*c* and the joint recesses 28*b* and 36*b* are allowed to move back and forth relative to each other by their small gaps. As a result, the cam lobe slide 32 slightly precedes the cam shaft 9** (at 90 degrees of the second row to 270 degrees of the second row).

Incidentally, the preceding movement of the cam lobe slider 32 can suppress the noise which is generated from the gap between the dowels **31*c* and 33*c* and the joint recesses 28*b* and 36*b***.

When the state of 270 degrees of the second row is reached, the joint pin 20 rotating together with the cam shaft 9 has arrived at the rear end of the slot **32*a* of the cam lobe slider 32 so that the cam lobe slider 32 cannot precede with the cam shaft 9** any more.

Since, at this time, the cam lobe slider 32 has preceded the left-hand and right-hand free cam lobes 31 and 33, the steeply sloped end faces **31*g* and 33*g* of the free cam lobes 31 and 33 are held partially at their leading ends in contact with the left-hand and right-hand steeply sloped end faces 32*c* and 32*c* of the cam lobe slider 32**.

This state is the complete valve actuating state (at 270 degrees of the second row to 180 degrees of the third row), as shown in FIG. 1. If it is assumed in the table of FIG. 8 that the joint pin 20 is extracted at 270 degrees of the third row to come out of the slot **32*a* of the cam lobe slider 32, this cam lobe slider 32 is free to rotate relative to the cam shaft 9. As a result, the free cam lobes 31 and 33 are allowed to slide toward each other because they are freed of the forced contact of their steeply sloped end faces. However, the side faces of the cylindrical portions 31*b* and 33*b* of the free cam lobes 31 and 33 come into contact with the trigger pins 41 and 43 so that the sliding motions are temporarily inactivated before the dowels 31*c* and 33*c* leave the joint recesses 28*b* and 36*b* of the connectors 28 and 36** (at 0 degree of the fourth row).

FIG. 4 shows the state in which the sliding motions of the free cam lobes 31 and 33 are temporarily inactivated by the trigger pins 41 and 43. In this state, the free cam lobes 31 and 33 still rotate together with the cam shaft 9.

When the free cam lobes 31 and 33 rotate by 90 degrees together with the cam shaft 9, the notch **31*e* formed in the cylindrical portion 31*b* of the free cam lobe 31 reaches the right-hand trigger pin 41 to release the regulation so that the free cam lobe 31 starts its leftward sliding motion (at 90 degrees of the fourth row). With a delay of 90 degrees, the regulation by the left-hand trigger pin 43 is released so that the free cam lobe 83 also starts its rightward sliding motion (at 180 degrees of the fourth row). The dowels 31*c* and 33*c* of the free cam lobes 31 and 33 sequentially leave the joint recesses 28*b* and 36*b* of the connectors 28 and 36 so that the free cam lobes 31 and 33 can rotate freely of the cam shaft 9** (at 180 degrees of the fourth row and at 270 degrees of the fourth row).

FIG. 5 shows the state in which the free cam lobes 31 and 33 are made freely rotatable. The valve 3 is not actuated by the free cam lobes 31 and 33 but is rested.

In this state, the dowels **31*d* and 33*d* protruded from the cylindrical portions 31*b* and 33*b* of the free cam lobes 31 and 33 come into abutment against the abutment face 34*f* of the arm portion 34*d* to inactivate the inertial rotation of the free cam lobes 31 and 33, because the arm portion 34*d* of the free cam catch arm 34 is positioned in the rotating direction of the dowels 31*d* and 33*d***.

Since the inertial rotation of the free cam lobes 31 and 33 is thus forcibly inactivated, the actuation of the valve 3 by the free cam lobes 31 and 33 freed to rotate can be avoided to prevent an abrupt seating of the valve thereby to reduce the noise and to prevent damage to the engine and the reduction of the output.

The other arm portion **34*c* of the free cam catch arm 34 is held by the damper pin 45, as shown in FIG. 7. As a result, even if the dowels 31*d* and 33*d* collide against the one arm portion 34*d*, the collision energy is absorbed by the damper spring 46 urging the damper pin 45**.

Since, moreover, the oil reservoir 52 is formed above the arm portion **34*d*, as described above, the impact of the dowels 31*d* and 33*d* upon the arm portion 34*d*** is damped. As a result, it is possible to reduce the noise and to improve the durability.

The timing for the free cam lobes 31 and 33 to be disengaged from the connectors 28 and 36 for free rotations occurs not when the joint pin 20 comes out of the slot **32*a* of the cam lobe slider 32 but when the regulation of the sliding motion of the free cam lobes 31 and 33 by the trigger pins 41 and 43 is released. As a result, the free cam lobes 31 and 33 are set free for rotation at the instant of a constant rotational angle of the free cam lobes 31 and 33, that is, when the dowels 31*d* and 33*d* of the free cam lobes 31 and 33 take a predetermined positional relation to the arm portion 34*d* of the free cam catch arm 34. After the rotation of a predetermined angle by inertia, the dowels 31*d* and 33*d* come into abutment against the arm portion 34*d*** so that the rotation is inactivated without fail.

This makes it possible to prevent the free cam lobes 31 and 33 set free from influencing the operations of the valves.

In the present embodiment, the cam lobe slider 32 is made lighter than the free cam lobes 31 and 33. As a result, the joint pin 20 to be joined to the cam lobe slider 32 can be made thin and light so that the pin speed is accelerated to effect the switching at a high speed without fail.

Moreover, the joint of the free cam lobes 31 and 33 to the connectors 28 and 36 is caused by the engagement between the dowels **31*c* and 33*c* and the joint recesses 28*b* and 36*b*** so that the abutment is effected between the planes to reduce the facial pressure thereby to improve the durability.

Since, the joint recesses **28*b* and 36*b* provide the oil reservoirs, as described above, the collision energy with the dowels 31*c* and 33*c*** is damped to reduce the noise and to improve the durability.

Another embodiment of the present invention will be described with reference to FIGS. 10 to 15.

Figure 10:
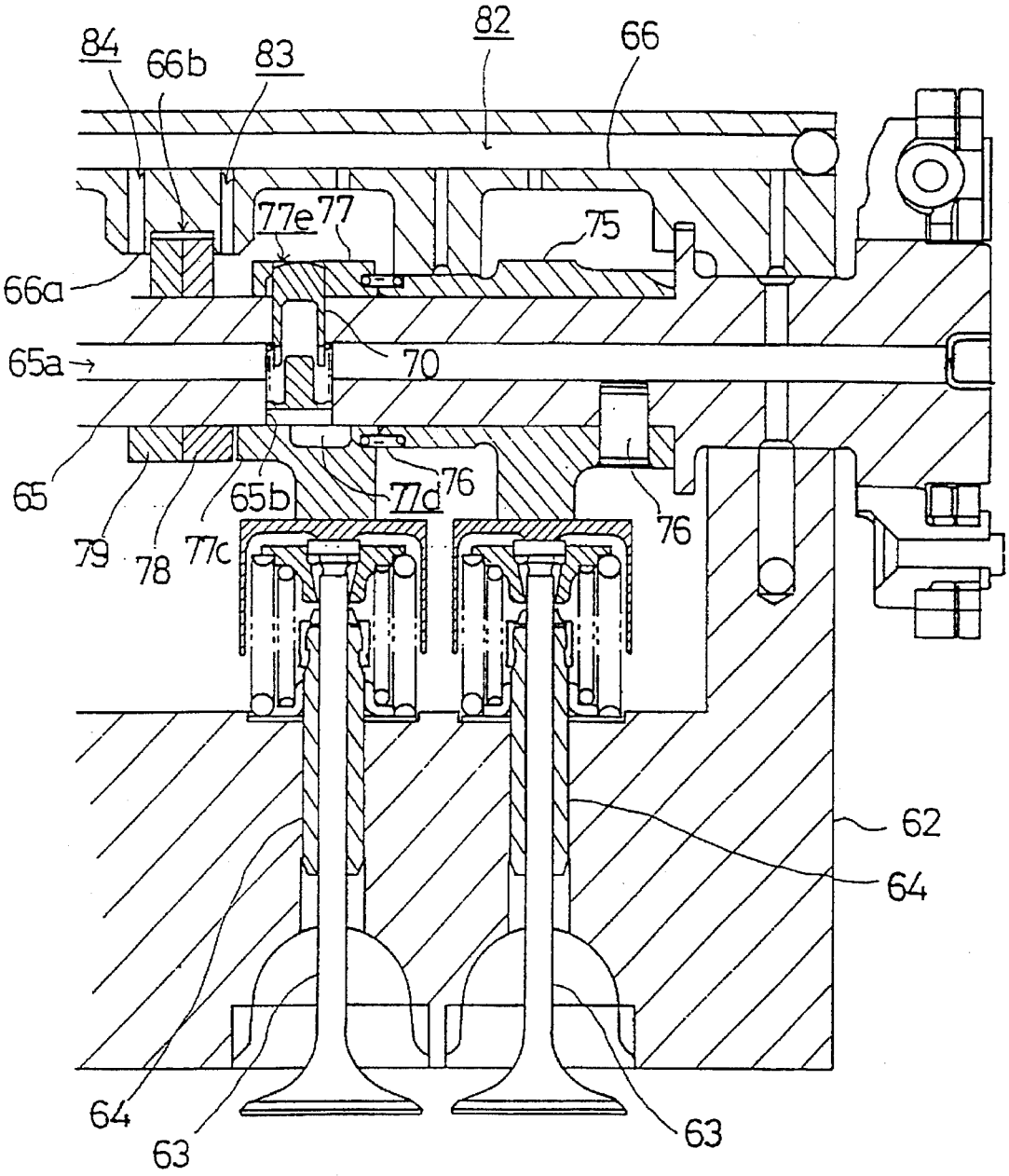
FIG. 10 shows a section of an essential portion of the engine of another embodiment.
Figure 15:
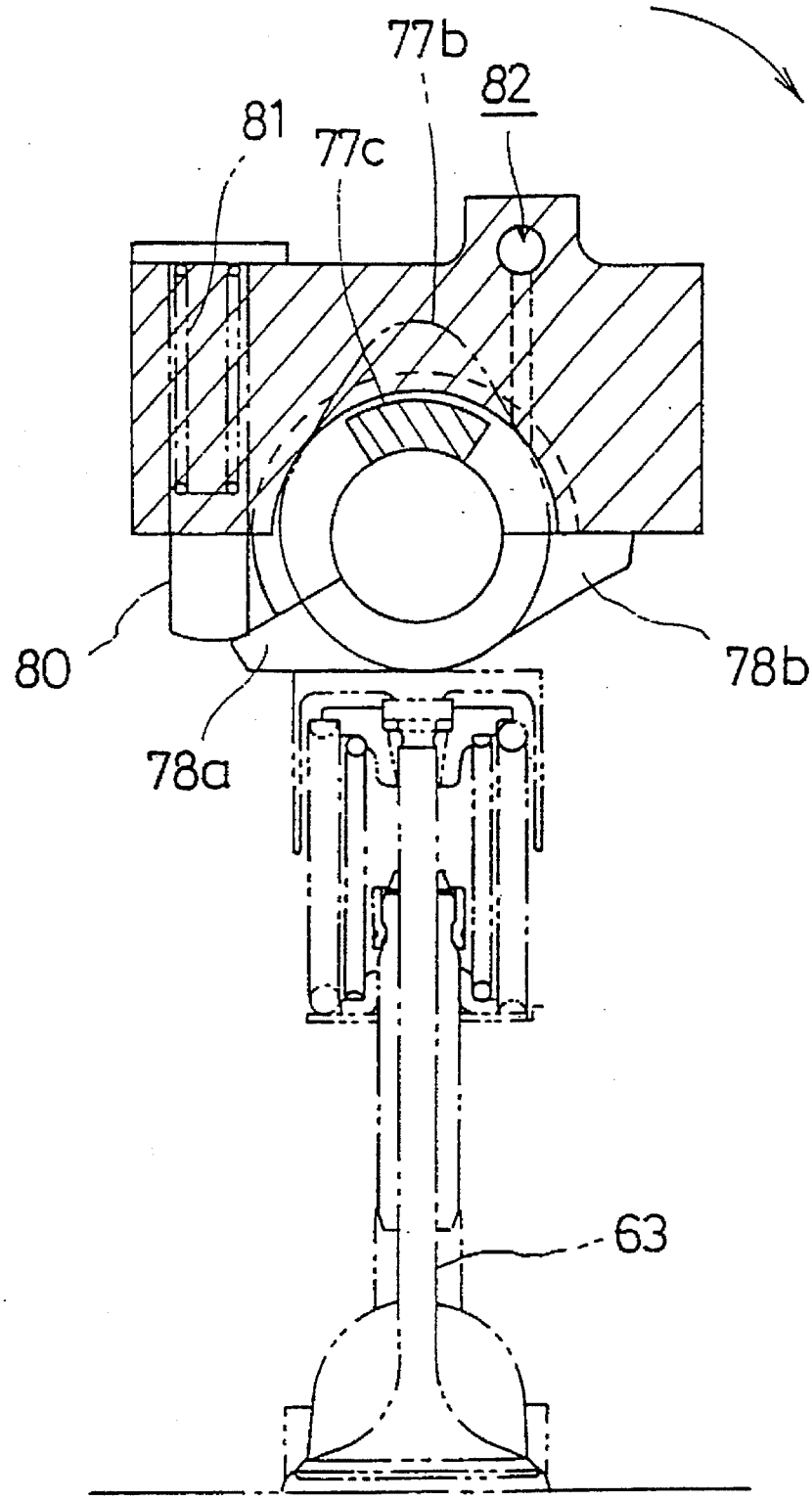
FIG. 15 shows a section XV—XV of FIG. 11.

FIGS. 10 and 15 are sections showing essential portions of the valve actuating mechanism in the engine of the present embodiment. Valves 63 are slidably supported in a cylinder head 62 through valve guides 64. A cam shaft 65, as located above them, is supported by bearings at the upper end of the cylinder head 62 and is rotatably gripped by a cam holder 66. The cam shaft 65 is formed therein with an oil passage **65*a* and with a through hole 65*b* in which a joint pin 70 is fitted across the oil passage 65*a* while being allowed to protrude from the outer circumference of the cam shaft 65**.

Figure 12:
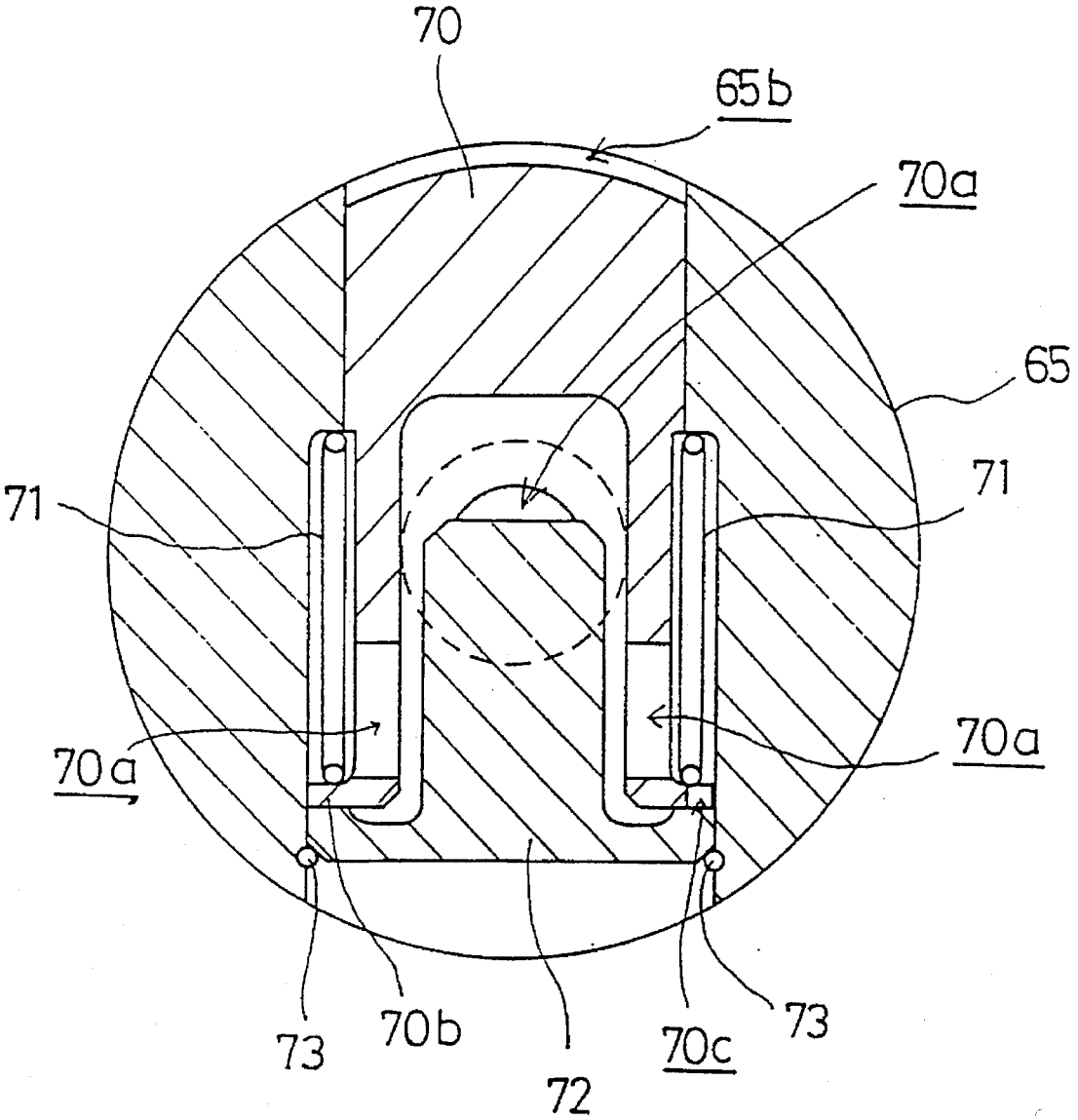
FIG. 12 shows a section of a joint pin portion of a cam shaft.

As shown in FIG. 12, the joint pin 70 is formed into a bottomed cylindrical shape and has its cylindrical wall formed at its left-hand and right-hand sides and at its front and back with transverse holes 70*a*. At its circumferential end, a flange 70*b* is formed on joint pin 70 to provide a retaining portion for a return spring 71. The flange 70*b* is circumferentially formed with a plurality of notches 70*c* for easily receiving the oil pressure.

The joint pin 70 is fitted in the through hole 65*b* through the return spring 71. The through hole has its top sealed by fitting a sealing plug 72 through a stop pin clip 73.

As a result, when the oil pressure is applied to the oil passage 65*a*, the joint pin 70 can be protruded through the transverse holes 70*a* from the outer circumference of the cam shaft 65 against the return spring 71. Without the oil pressure, the joint pin 70 is sunk inward from the outer circumference of the cam shaft 65 by the action of the return spring 71.

The aforementioned notches 70*c* formed in the flange 70*b* of the joint pin 70 improve the flow of the oil pressure, when the joint pin 70 goes in and out, to smooth the operations.

On the cam shaft 65 thus constructed, there is integrally fitted a rigid cam lobe 75 by fitting a fixing pin 76. At the left-hand side of the rigid cam lobe 75, a free cam lobe 77 is rotatably fitted. The free cam lobe 77 is axially slidable on the cam shaft 65 through the cam lobe slide spring 76.

Figure 13:
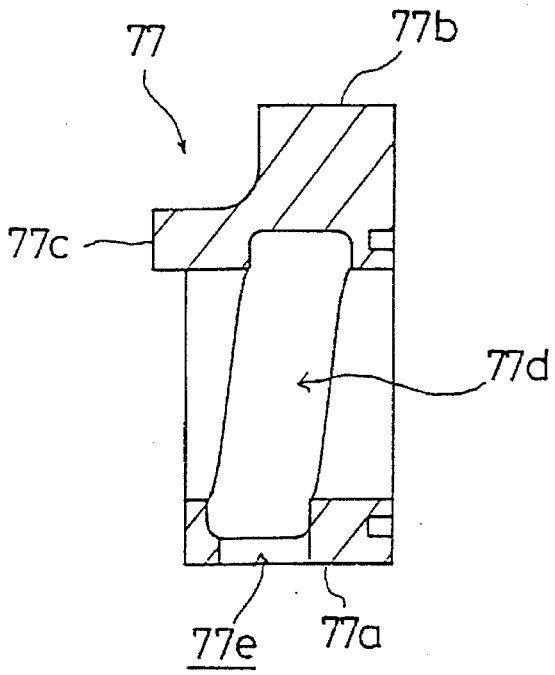
FIG. 13 shows a section of a free cam lobe.

As shown in section in FIG. 13, the free cam lobe 77 has its cylindrical portion 77*a* bulging in the centrifugal direction while being slightly offset sideways, to form a cam lobe 77*b*. The other circumferential end face of its cylindrical portion 77*a* has an arcuate dowel 77*c* extending therefrom.

Figure 14:
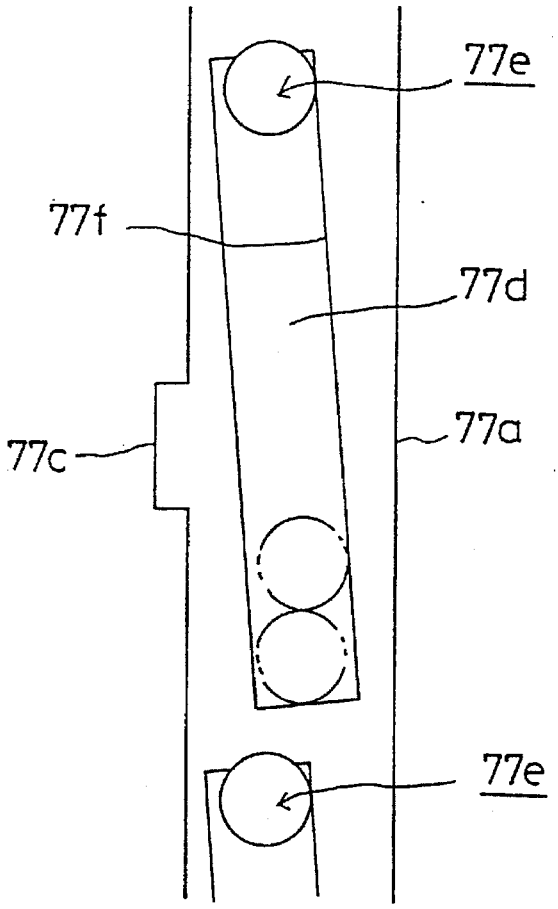
FIG. 14 shows an expanded diagram of the inner circumference of the same free cam lobe.

Moreover, the cylindrical portion 77*a* of the free cam lobe 77 has its inner circumference formed with a helical groove 77*d*, which is as wide as that of the leading end portion of the aforementioned joint pin 70. This joint pin 70 can be loosely fitted therein. If the inner circumference is expanded, the groove 77*d* is inclined with respect to the expanded inner circumference, as shown in FIG. 14.

This groove 77*d* is formed at its end portion with a circular joint hole 77*e* on the side opposite to the cam lobe 77*b*. The free cam lobe 77 is fitted in the position of the joint pin of the cam shaft 65 by the urging action of the aforementioned cam lobe slide spring 76. When the joint pin 70 is protruded by the oil pressure, the leading end portion of the cam lobe 77 is fitted at first in the groove 77*d* so that the turn of the joint pin 70 moves the free cam lobe 77 rightward against the cam lobe slide spring 76 while pushing the right-hand side 77*f* of the groove 77*d*. When the joint pin 70 arrives at the joint hole 77*e*, it comes into the same joint hole 77*e* to complete the joint, so that the free cam lobe 77 rotates together with the cam shaft 65.

FIG. 10 shows this state, in which the rotating free cam lobe 77 is actuating the valve 63.

At the left-hand side of the free cam lobe 77, there is rotatably fitted on the cam shaft 65 a free cam catch arm 78.

This free cam catch arm 78 is formed into a shape, in which the free cam catch arm 34 (as shown in FIG. 3) of the foregoing embodiment is generally halved in the horizontal direction, to have arm portions 78*a* and 78*b* protruding forward and backward (as shown in FIG. 15). A free cam catch arm 79 having an identical shape is symmetrically arranged adjacent to the free cam catch arm 78, and these two free cam catch arms 78 and 79 operate independently of each other.

When the free cam lobe 77 moves leftward, the arcuate dowel 77*c* protruded from the circumferential end face can abut against the arm portions 78*a* and 78*b* of the free cam catch arm 78.

The cam holder 66 is formed with a ridge 66*a* having a groove 66*b* for guiding the free cam catch arms 78 and 79 together. In the ridge 66*a*, as shown in FIG. 15, there is fitted a downwardly extending damper pin 80 at the side of the cam shaft 65, as shown in FIG. 15. The damper pin 80 is held by a damper spring 81 and has its generally lower half protruded downward to abut against one arm portion 78*a* of the aforementioned free cam catch arm 78.

Although not shown, another damper pin is provided for the other free cam catch arm 79, and a free cam lobe is arranged at the left-hand side of the free cam catch arm 79.

Figure 11:
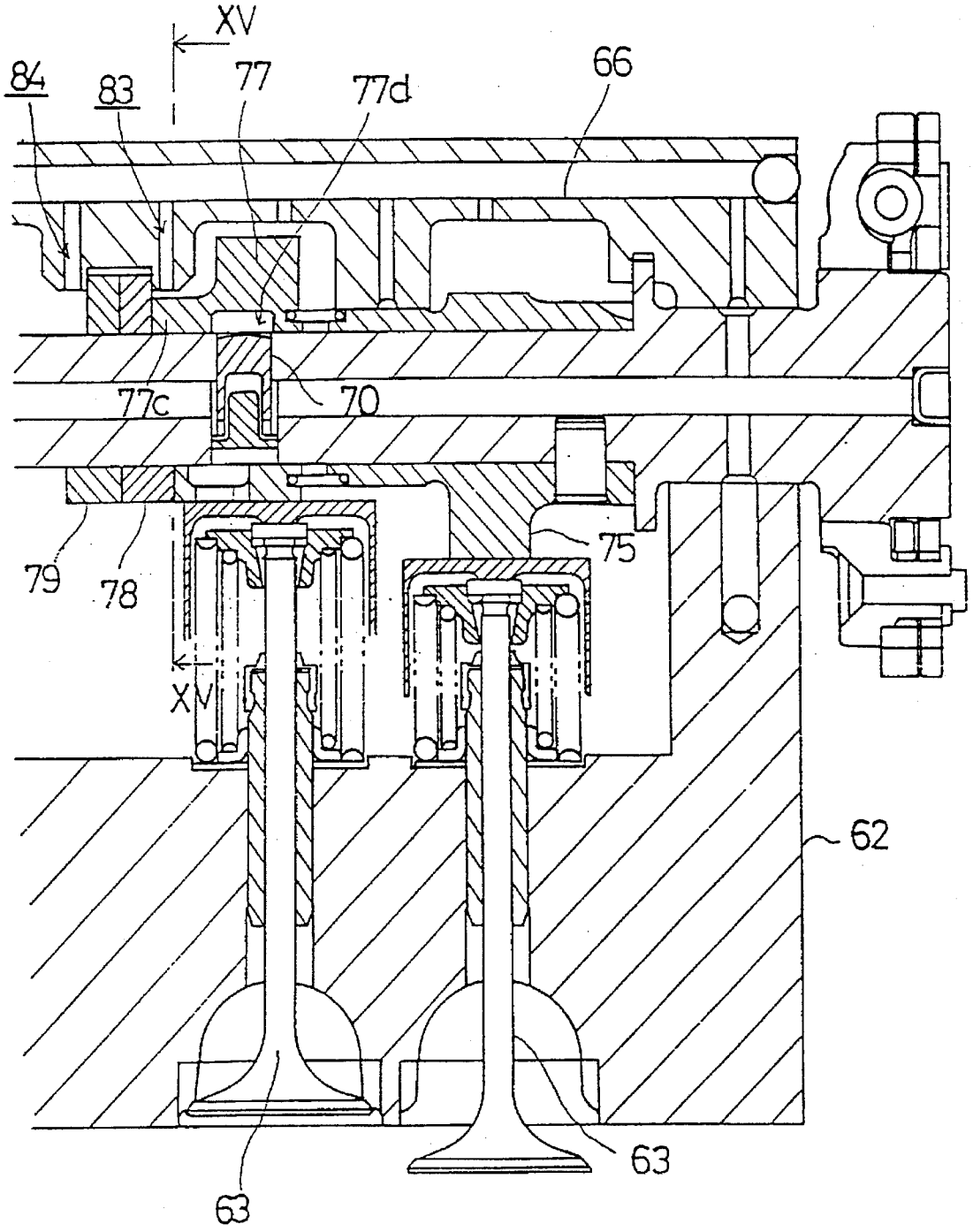
FIG. 11 shows a section of an essential portion of the engine of FIG. 10 in another state.

The cam holder 66 is formed, as shown in FIGS. 10 and 11, with an oil passage 82 directed in the axial direction. The oil passage 82 is branched into an oil branch extending to a desired portion of the cam shaft 65. At the two sides of the groove 66*b* of the ridge 66*a*, oil branches 83 and 84 are also formed for providing oil reservoirs above the other arm portion 78*b* of the free cam catch arm 78.

The valve drive control mechanism of the present embodiment has the structure thus far described. When the joint pin 70 is protruded by applying the oil pressure, as described above, it is fitted at first in the helical groove 77*d* formed in the inner circumference of the free cam lobe 77 and is joined, after having moved along the groove 77*d*, to the joint hole 77*e*. As a result, a sufficient time period is left from the instant of applying the oil pressure to the instant of the actual joint so that a sufficient protrusion can be retained from the joint pin to be fitted in the joint hole 77*e* independently of the oil pressure application timing. As a result, the cam shaft 65 and the free cam lobe 77 can be reliably joined without noise or reduction in output.

The free cam lobe 77 can be directly slid by the movement of the joint pin 70 along the groove 77*d* in the inner circumference of the free cam lobe 77. As a result, the structure can be simplified while easily retaining the space for arranging the free cam catch arms 78 and 79 and so on.

When the joint pin 70 is reliably fitted in the joint hole 77*e* so that the free cam lobe 77 is joined to rotate together with the cam shaft 65, the free cam lobe 77 actuates the valve 63 (as shown in FIG. 10).

When the joint pin 77 is sunk to come out of the joint hole 77*e*, the free cam lobe 77 is set free for rotation from the cam shaft 65 and for axial sliding motion. As a result, the free cam lobe 77 is slid leftward by the cam lobe slide spring 76 so that the dowel 77*c* protruded from the side face thereof can come into abutment against the arm portion 78*b* of the free cam catch arm 78.

As a result, the free cam lobe 7 thus set free for rotation and rotating by the inertial force is halted by having its dowel 77*c* abutting against the arm portion 78*b* so that the action of the valve 63 by the free cam lobe 77 set free for rotation can be avoided to prevent the abrupt seating of the valve thereby to reduce the noise and to prevent the reduction of the output.

Since the other arm portion 78*a* of the free cam catch arm 78 is held by the damper pin 80, as shown in FIG. 15, the collision energy is absorbed, even if established by the collision of the dowel 77*c* against the one arm portion 78*b*, by the damper spring 81 urging the damper pin 80.

Since, moreover, the oil reservoir is formed above the arm portion 78*b*, as described above, the collision force due to the collision of the dowel 77*c* against the arm portion 78*b* can be damped to reduce the noise and to improve durability.

Figure 16:
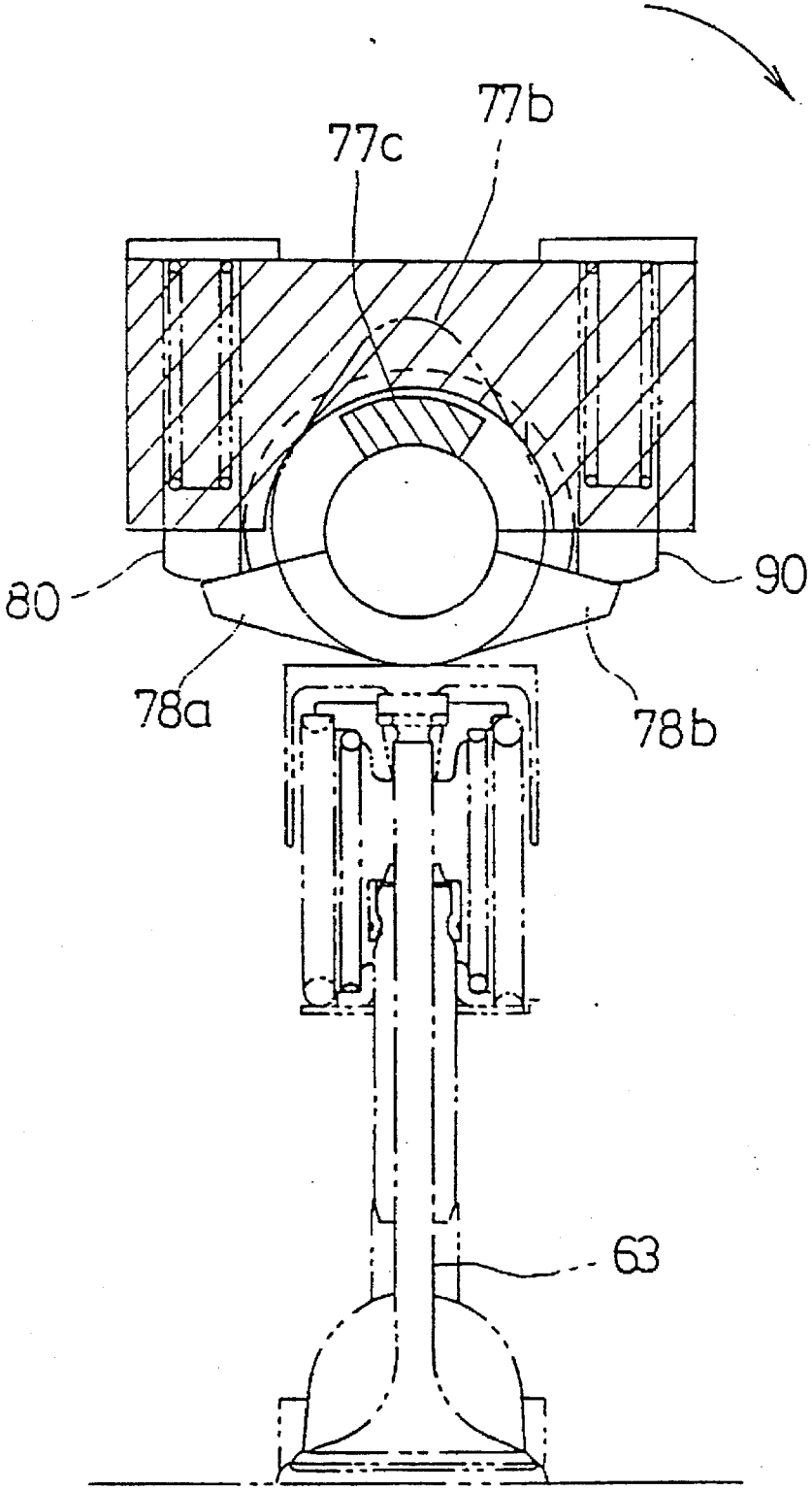
FIG. 16 shows a section of an essential portion an example having two damper pins.

Incidentally, with reference to FIG. 16, an example will now be described in which front and back damper pins are used for absorbing the collision force at the time of stopping rotation of the free cam lobe 77 by the inertial force.

Specifically, another damper pin 90 is disposed in a symmetric position with respect to the cam shaft 65 in addition of the damper pin 80 of the aforementioned embodiment. The additional damper pin 90 has its leading end abutting against the upper face of the arm portion 78*b* of the free cam catch arm 78.

Since the front and rear armportions 78*a* and 78*b* of the free cam catch arm 78 are respectively held by the damper pins 80 and 90, the rotation of the free cam lobe 77 is not yet inactivated even when the dowel 77*c* comes into abutment against the arm portion 78*b*. At the time of reverse rotation, the dowel 77*c* abuts against the arm portion 78*a*, but the collision force can also be absorbed to establish a high attenuating force.

Next, modifications of a groove to be formed in the inner circumference of the free cam lobe are shown in the exploded diagrams of the inner circumference in FIGS. 17 and 18.

In the modification of FIG. 17, a groove 96 of a free cam lobe 95 has its right-hand side face 96*a* as it is in the foregoing embodiment but its left-hand side face is eliminated and opened sideways.

As a matter of fact, the joint pin is fitted in the groove 96 to slide the free cam lobe 95 rightward. This action is caused by the fact that the joint pin slides on the right-hand side face 96*a* of the groove 96. Hence, this action is sufficed by the right-hand side face 96*a*. By opening the left-hand side, the free cam lobe 95 can be forged to improve the productivity.

In the example of FIG. 18, a free cam lobe 98 has its groove 99 generally divided into three portions. A portion 99*a* near the front end and a portion 99*c* near the rear end are perpendicular to the axial direction and with a slight shift in the axial direction. An intermediate portion 99*b* is sloped and connects the front end portion 99*a* and the rear end portion 99*c*. When the joint pin is fitted in the groove 99, the free cam lobe 98 is slid in the intermediate portion 99*b*.

Since the front end portion 99*a* of the groove 99 directed perpendicular to the axial direction is formed with a joint hole 100 at its front end, the joint pin can be easily fitted and reliably joined.

Another embodiment will be described with reference to FIGS. 19 to 24.

A free cam lobe 110 of the present embodiment is identical, in the groove in its inner face and the joint hole, to the free cam lobe 77 of the foregoing embodiment. The free cam lobe 110 is slid (rightward of FIG. 19) by fitting a joint pin 111 in a helical groove and is joined to the joint hole so that it is rotated together with a cam shaft 112.

Figure 22:
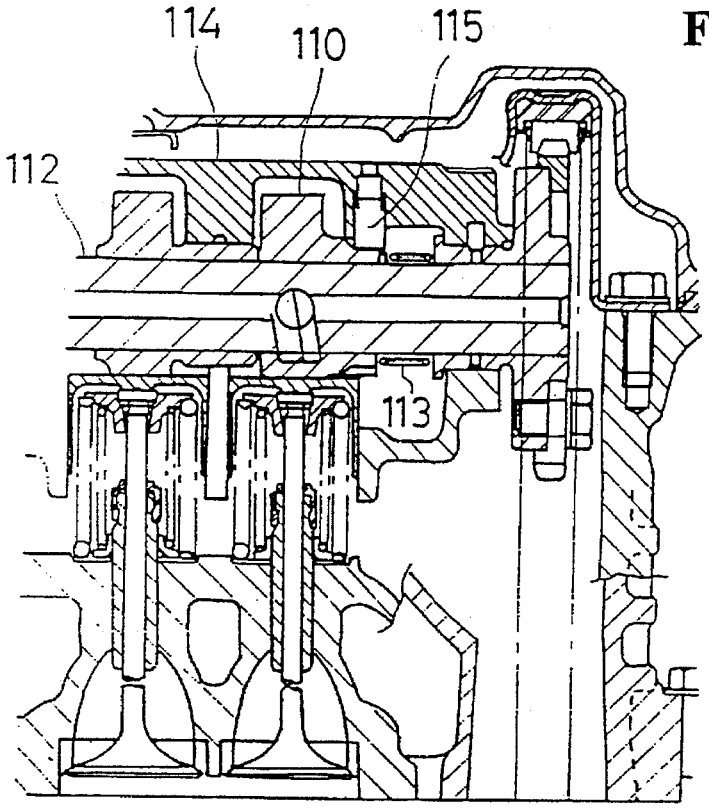
FIG. 22 shows a section of an essential portion of an engine of FIG. 19 in another state.

When the joint pin 111 comes out from the joint hole and the groove, the free cam lobe 110 is set free for rotation and is slid leftward of FIG. 22 by the action of a spring 113.

Figure 19:
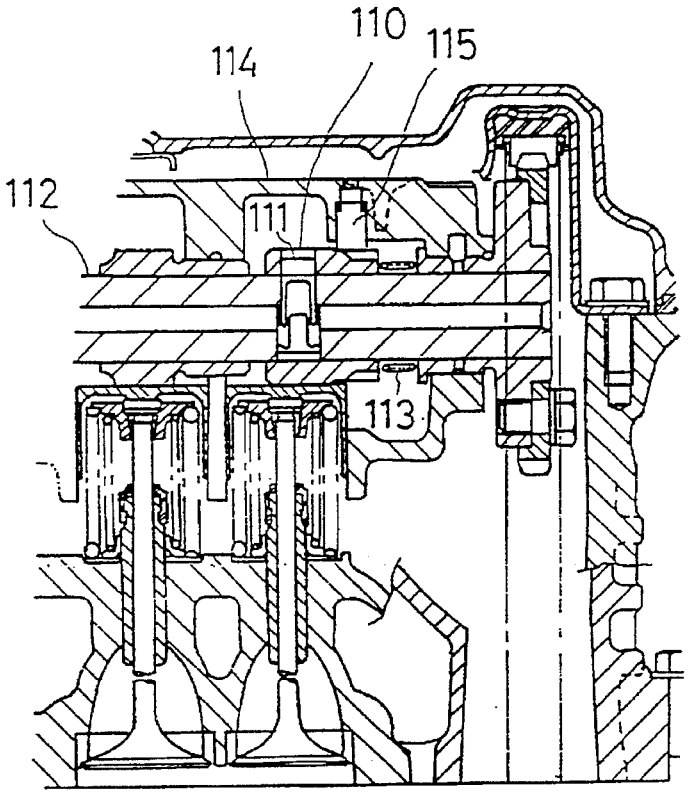
FIG. 19 shows a section of an essential portion of an engine of another embodiment.
Figure 20:
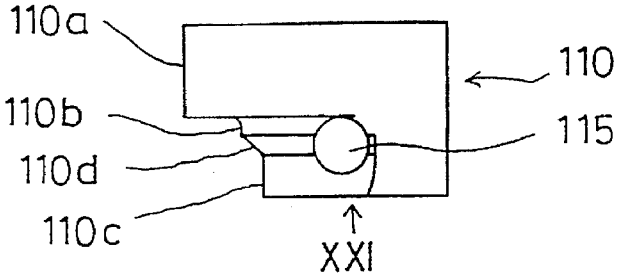
FIG. 20 shows a diagram showing the relation of the free cam lobe and a stopper pin in the same state.
Figure 21:
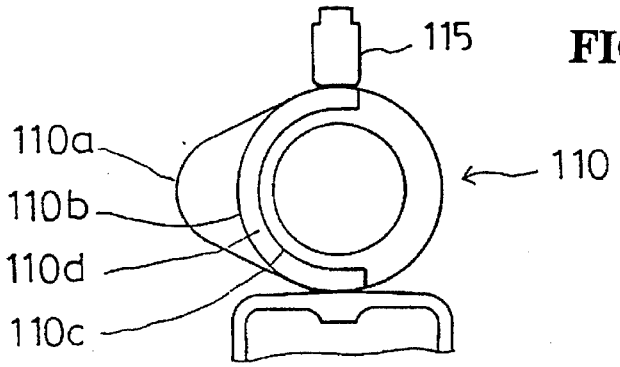
FIG. 21 shows a view taken in the direction of arrow XXI of FIG. 20.

In the free cam lobe 110, as shown in FIGS. 20 and 21, the right-hand side face, as viewed in FIG. 19, of the portion having a cam lobe 110*a* bulges to form a cylindrical portion 110*b* having the same diameter as that of the arcuate portion of the cam. The semicircular portion at the side of the cam lobe 110*a* of the circumferential edge of the cylindrical portion 110*b* is notched to form a semi-cylindrical portion 110*c* having a smaller diameter. This semi-cylindrical portion 110*c* and the aforementioned cylindrical portion 110*b* are connected to a taper portion 110*d*.

Figure 23:
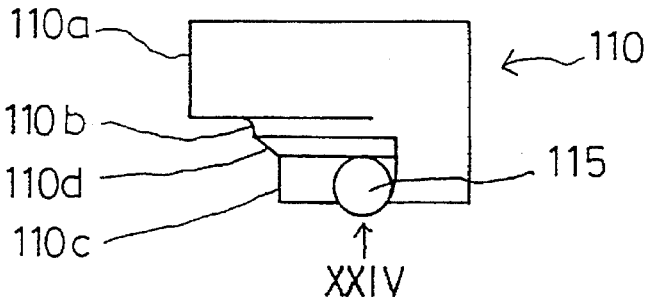
FIG. 23 shows a diagram showing the relation between the free cam lobe and the stopper pin in the same state.
Figure 24:
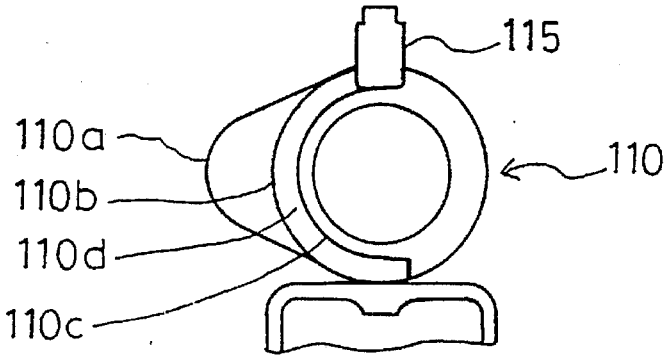
FIG. 24 shows a diagram taken in the direction of arrow XXIV of FIG. 23.

In a predetermined position of a cam holder 114, on the other hand, a stopper pin 115 extends toward the cylindrical portion 110*b* of the free cam lobe 110. The stopper pin 115 is urged by the action of a spring 116. When the joint pin 111 is joined to the joint hole so that the free cam lobe 110 rotates together with the cam shaft 112, the free cam lobe 110 is off-set rightward, as shown in FIG. 19, and the stopper pin 115 is brought along the cam side face of the free cam lobe 110, as shown in FIGS. 20 and 21, into abutment against the circumference of the cylindrical portion 110*b* so that the rotation of the free cam lobe 110 is not regulated. However, the joint pin 111 comes out of the joint hole and the groove to set the free cam lobe 110 free for rotation. When slid leftward by the action of the spring 113, the stopper pin 115 is not fitted in the notch of the cylindrical portion 110*b*, as shown in FIGS. 22 to 24, but smoothly reaches the circumference of the semi-cylindrical portion 110*c* via the taper portion 110*d*. As a result, the free cam lobe 110 inertially rotating comes into abutment against the terminal end face of the semicircular portion 110*c* so that it is halted.

On the contrary, when the joint pin 111 protrudes through the groove to slide the free cam lobe 110 rightward, the stopper pin 115 can smoothly reach the circumference of the cylindrical portion 110*b* through the taper portion 110*d*.

Despite the simple structure of the present embodiment, the free cam lobe 110 set free for inertial rotation is halted by the stopper pin 115 so that the valve can be prevented from abrupt seating to reduce the noise and to prevent a reduction of the output.

Like the foregoing embodiments, moreover, the joint pin 111 can be easily joined to the joint hole of the free cam lobe 110 to ensure the engagement/disengagement with/from the cam shaft 112.

Figure 25:
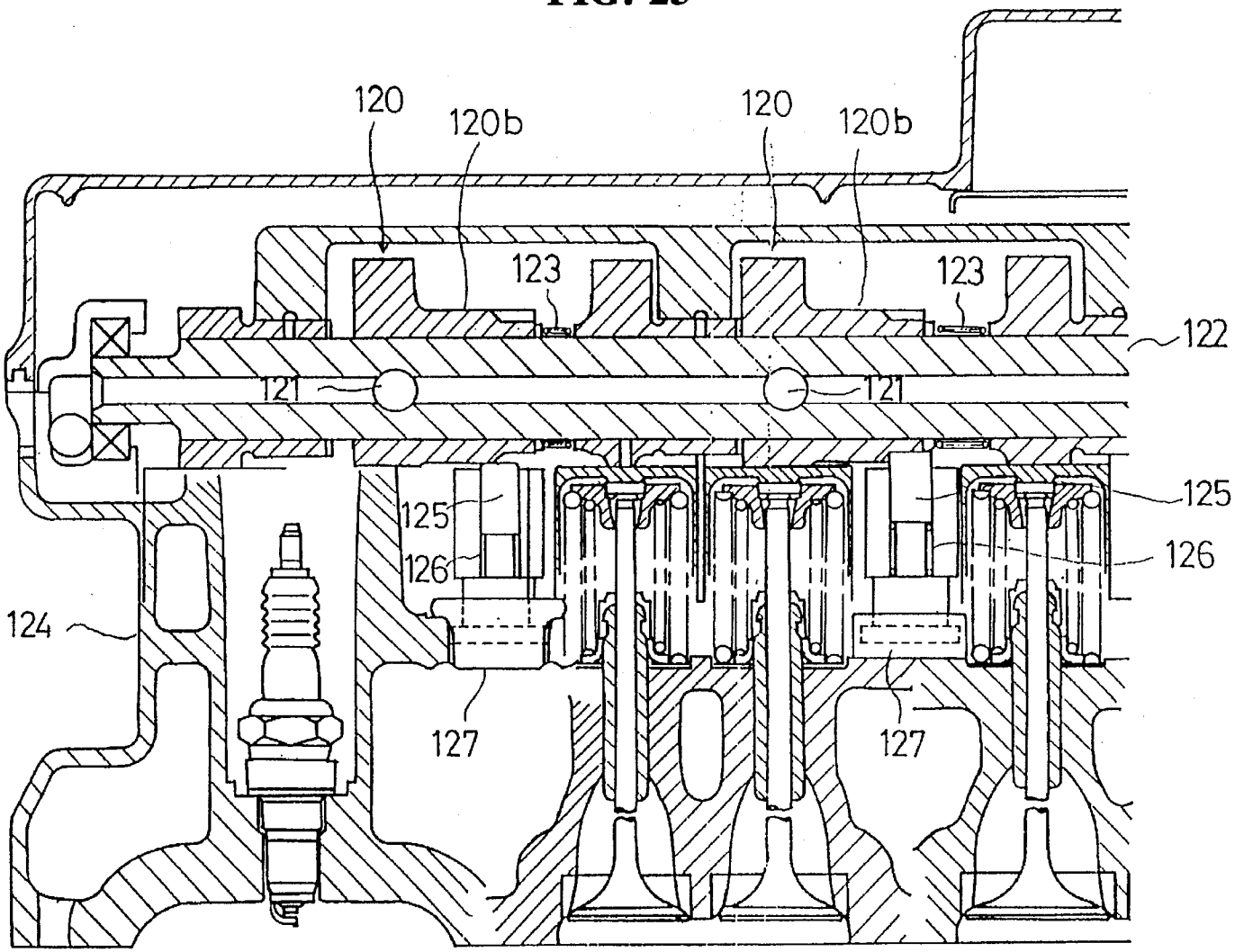
FIG. 25 shows a section of an essential portion of an engine of another embodiment.

In the aforementioned embodiment, the stopper pin 115 is disposed at the side of the cam holder 114 but may be disposed at the side of the cylinder head, as exemplified in FIG. 25.

A free cam lobe 120, a joint pin 121, a cam shaft 122, a spring 123 and so on are identical to those of the foregoing embodiments, but a stopper pin 125 is disposed at the side of a cylinder head 124.

Between the valve lifters of each cylinder of the cylinder head 124, the stopper pin 125 is supported by a mounting fixture 127. The stopper pin 125 is urged toward the cylindrical portion of the free cam lobe 120 by the action of a spring 126.

FIG. 25 shows the two free cam lobes 120 at the left-hand and right-hand sides, of which the left-hand free cam lobe 120 is in the active valve state whereas the right-hand free cam lobe 120 is in the inactive valve state.

The left-hand stopper pin 125 just abuts against the circumference of a cylindrical portion 120*b* of the free cam lobe 120 but does not regulate the rotation. However, when the joint pin 121 comes out of the joint hole and the groove of the free cam lobe 120 so that the free cam lobe 120 is slid (in the leftward direction of FIG. 25) by the action of the spring 123, the stopper pin 125 is fitted, as in the right-hand free cam lobe 120, in the notch of the cylindrical portion 120*b* to abut against the circumference of a semicylindrical portion 120*c* until it is stopped by the terminal end face.

As a result, the free cam lobe 110 set free for inertial rotation is halted in its rotation by the stopper pin 125 so that it can prevent the abrupt seating of the valve to reduce the noise and to prevent the reduction of the output.

Another embodiment will be described with reference to FIGS. 26 to 28.

A free cam lobe 130 of the present embodiment is identical, in the groove of its inner face and the joint hole, to the free cam lobe 120 of the aforementioned embodiment. A joint pin 131 is fitted in the helical groove to slide the free cam lobe 130 (in the rightward direction of FIG. 26) into the joint hole so that the free cam lobe 130 may rotate together with a cam shaft 132.

Figure 26:
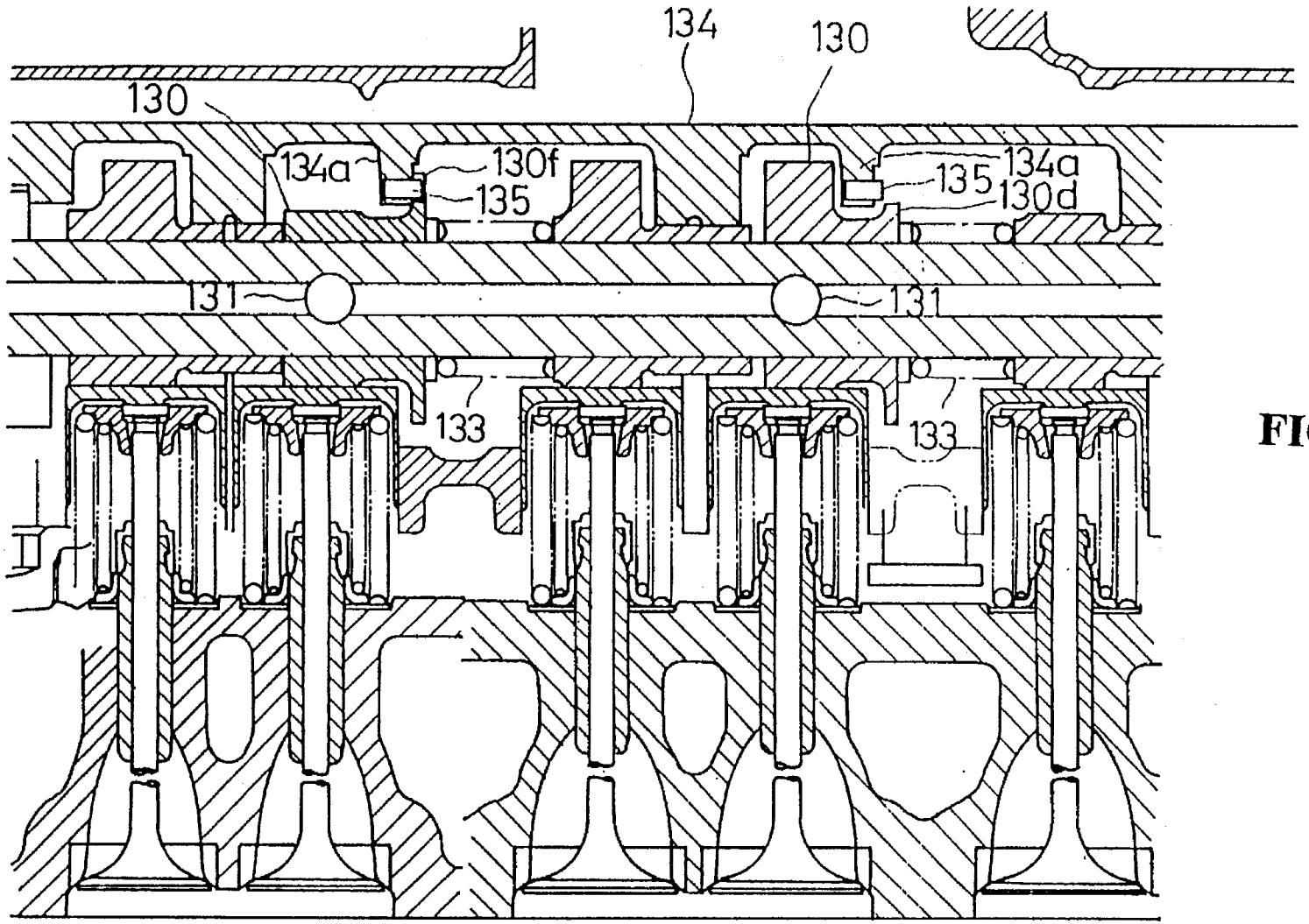
FIG. 26 shows a section of an essential portion of an engine of still another embodiment.

When the joint pin 131 comes out of the joint hole and the groove, the free cam lobe 130 is set free for rotation and is slid leftward of FIG. 26 by the action of a spring 133.

The free cam lobe 130 is formed, as shown in FIGS. 27 and 28, with a cam portion 130*b* having a cam lobe 130*a*, a cylindrical portion 130*c* having its side face bulging in a cylindrical shape and a flanged portion formed at the end edge of the cylindrical portion 130*c*. The flanged portion 130*d* is formed of a smaller-diameter semicircular disc portion 130*e* and a larger-diameter semicircular disc portion 130*f*. The smaller-diameter disc portion 130*e* is positioned at the side of the cam lobe 130*a*.

At the side of a cam holder 134, on the other hand, a bracket 134*a* is extended between the cam portion 130*b* and the flanged portion 130*d* of the free cam lobe 130. The bracket 134*a* is equipped with a stopper pin 135 projected toward the flanged portion 130*d* in the axial direction.

The stopper pin 135 is positioned, as shown by double-dotted lines in FIG. 28, at the diametrical position which is larger than the smaller-diameter disc portion 130*e* and larger than the larger-diameter disc portion 130*f* from the center of rotation of the free cam lobe 130.

FIG. 26 shows the two free cam lobes 130 at the left-hand and right-hand sides, of which the right-hand free cam lobe 130 is in the active valve state whereas the left-hand free cam lobe 130 is in the inactive valve state.

The right-hand free cam lobe 130 is slid rightward as the joint pin 131 passes through the groove, and its rotation is not regulated because it does not interfere with the flanged portion 13*d* which is positioned at the right-hand of the stopper pin 135. However, when the joint pin 131 comes out of the joint hole of the free cam lobe 130 and the groove so that the free cam lobe 130 is slid (in the leftward direction of FIG. 26) by the action of the spring 133, the flanged portion 130*d* comes to the position of the stopper pin 135, as in the left-hand free cam lobe 130, so that the stopper pin 135 is positioned on the outer circumference of the smaller-diameter disc portion 130*e*. As a result, the stopper pin 135 comes into abutment against the step portion of the terminal end of the smaller-diameter-disc portion 130*e* to merge into the larger-diameter disc portion 130*f*. Then, the free cam lobe 130 having been set free for the inertial rotation is rotationally halted by the stopper pin 135 so that it can prevent the abrupt seating or the like.

Still another embodiment will be described with reference to FIGS. 29 to 40.

Figure 29:
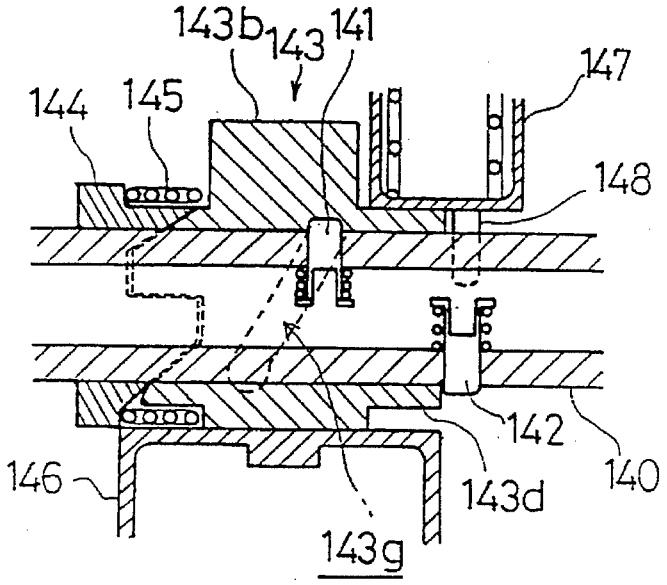
FIG. 29 shows a section of an essential portion of the valve active state of an engine in still another embodiment.
Figure 30:
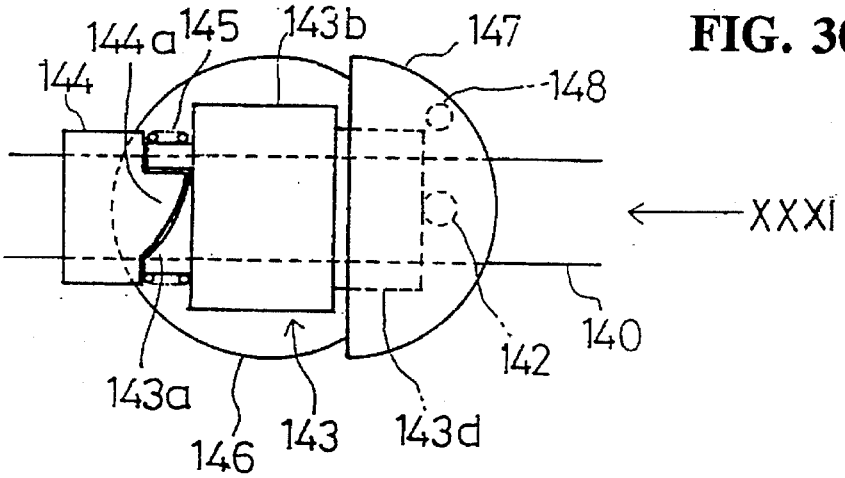
FIG. 30 shows a top plan view of the essential portion of FIG. 29.
Figure 31:
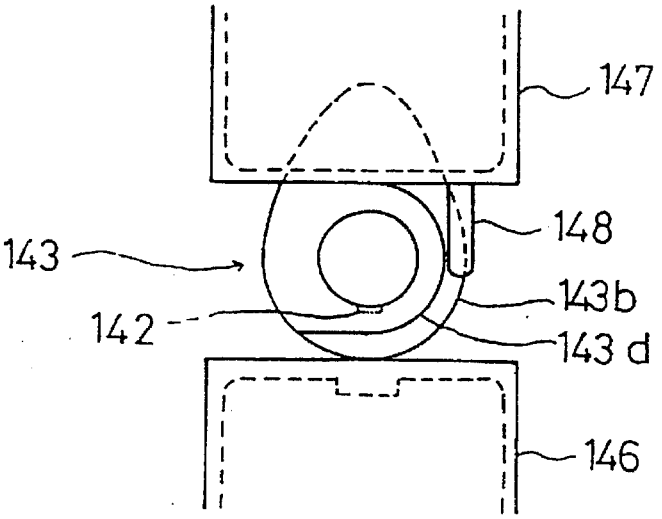
FIG. 31 shows a diagram taken in the direction of XXXI of FIG. 30.

FIG. 29 is a section showing only an essential portion of the valve actuating mechanism of the present embodiment. In a cam shaft 140, a joint pin 141 and a dowel lock pin 142 are fitted which are axially offset from each other and urged to freely go into and out of the cam shaft 140 by the action of a spring.

On the outer circumference of the cam shaft 140, at which the joint pin 141 is disposed, a free cam lobe 143 is rotatably and slidably fitted. Adjacent to this cam lobe 143, a connector 144 is fitted in position. This connector 144 and the free cam lobe 143 are formed in their opposed end faces with engagement recesses and bulging portions 143*a* and 144*a*, between which a spring 145 is sandwiched.

A valve lifter 146 is arranged to have its upper face abutting against the lower face of the free cam lobe 143, and a damper bucket 146 is arranged to have its lower face abutting against the upper face of the free cam lobe 143.

The damper bucket 147 is formed into a bottomed semi-cylindrical shape which is formed with an oil chamber in its upper support portion and equipped therein with a spring for applying a downward urging force.

From a predetermined portion of the bottom face of the damper bucket 147, on the other hand, a downwardly protruding stopper pin 148 is urged downwardly by a spring. Incidentally, this stopper pin 148 protrudes at a predetermined position offset sideways from the cam shaft 140.

Figure 32:
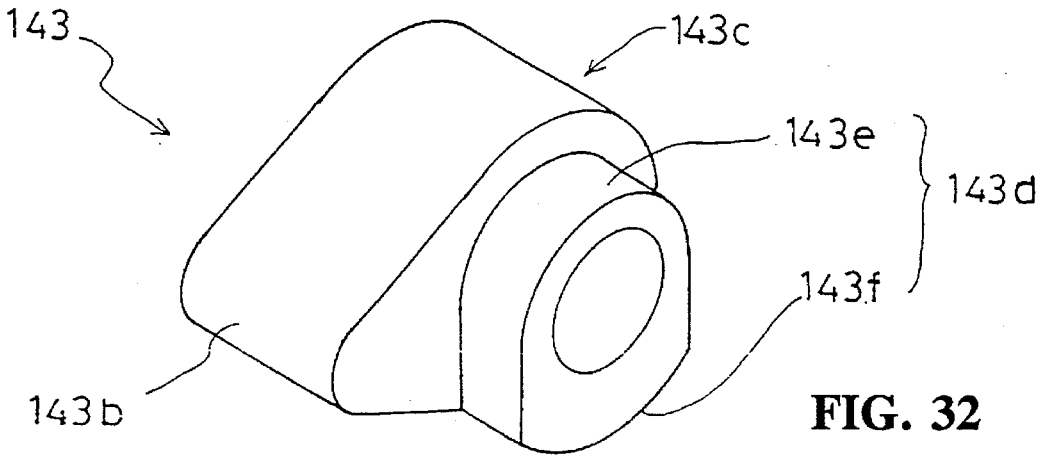
FIG. 32 shows a perspective view of the free cam lobe of the embodiment of FIG. 29.
Figure 33:
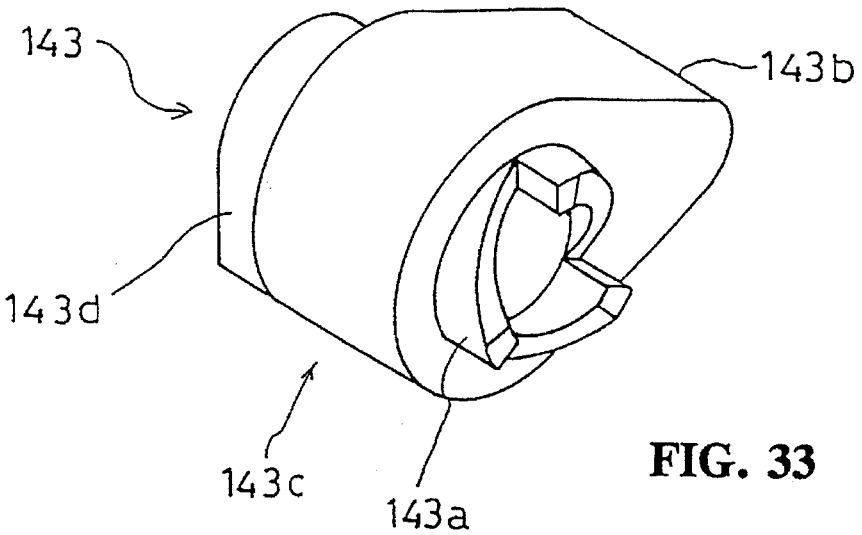
FIG. 33 shows a perspective view of the free cam lobe, as viewed from another view point.

The free cam lobe 143 of the present embodiment is formed, as shown in FIGS. 32 and 33, with a cam portion 143*c* having the aforementioned engagement bulging portion 143*a* and a cam lobe 143*b*. The free cam lobe 143 also has a deformed cylindrical portion 143*d*. This deformed cylindrical portion 143*d* is formed of a bulging portion 143*f* which is made to bulge from the side opposed from a semi-cylindrical portion 143*e* having a smaller diameter than the minimum of the cam portion 143*c*, to adjust the end face to the minimum diameter of the cam portion 143*c*. The bulging portion 143*f* is angularly displaced by 90 degrees from the cam lobe 143*b* of the cam portion 143*c*.

Moreover, the free cam lobe 143 is formed in its inner circumference with a helical groove 143*g* having a semicircular length for receiving the joint pin 141.

The present embodiment has the construction thus far described, and FIG. 29 shows the valve activating state, in which the joint pin 141 threads through the helical groove 143*g* in the inner circumference of the free cam lobe 143 and moves to the left so that the connector 144 and the engagement recesses and bulging portions 143*a* and 144*a* are brought into engagement and rotated together.

At this time, the dowel lock pin 142 is protruded along the side face of the deformed cylindrical portion 143*d* of the free cam lobe 143 to lock the free cam lobe 143 against the rightward sliding motion, and the damper bucket 147 is in abutment against the outer circumference of the deformed cylindrical portion 143*d*.

Figure 34:
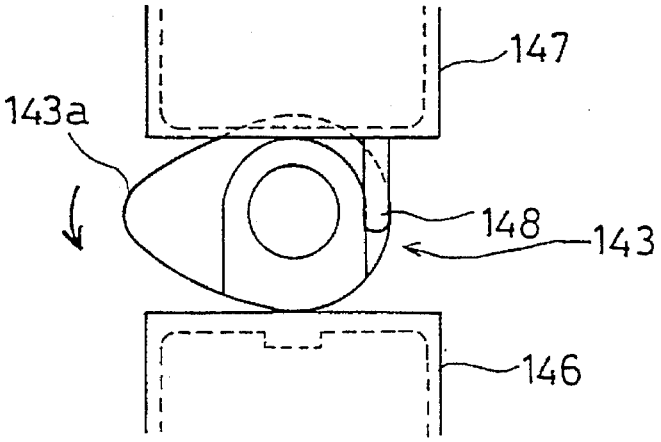
FIG. 34 shows a diagram showing the state in which a turn of 90 degrees is made from the state shown in FIG. 31.
Figure 35:
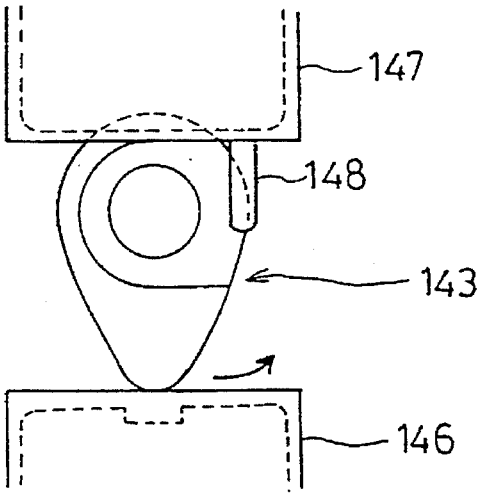
FIG. 35 shows a diagram showing the state in which a turn of 90 degrees is made from the state shown in FIG. 34.
Figure 36:
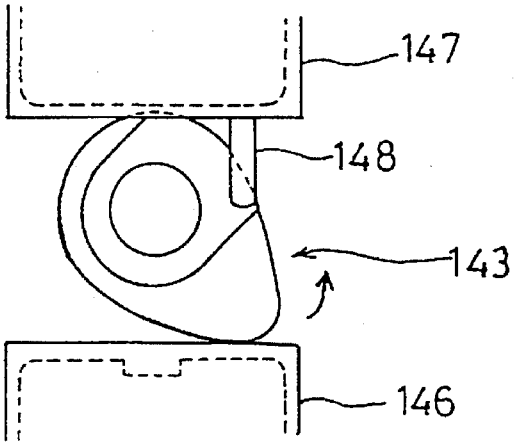
FIG. 36 shows a diagram showing the state in which a turn of 45 degrees is made from the state shown in FIG. 35.

In this state, the free cam lobe 143 rotates together with the cam shaft 140 through the connector 144 to actuate the valve (as shown in FIGS. 34 to 36).

The joint pin 141 and the dowel lock pin 142 are protruded together by the oil pressure. When the oil pressure is lowered to retract the joint pin 141 and the dowel lock pin 142 simultaneously, the free cam lobe 143 is slid to the right by the spring 145. Depending upon the angle of rotation, however, the side face of the cam portion 143*c* comes into abutment against the damper bucket 147 contacting with the outer circumference of the deformed cylindrical portion 143*d* of the free cam lobe 143, as shown in FIG. 34, to block the movement of the free cam lobe 143.

Figure 37:
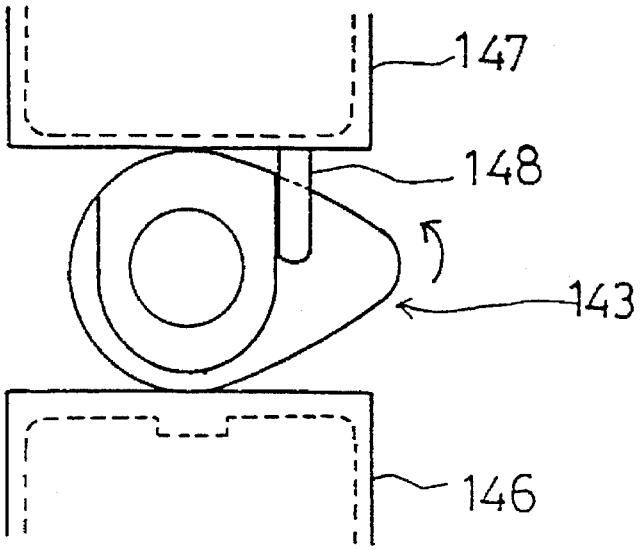
FIG. 37 shows a diagram showing the state in which a turn of 45 degrees is made from the state shown in FIG. 36.

As a result, the free cam lobe 143 continues its rotation while engaging with the connector 144, as shown in FIGS. 35 and 36, to actuate the valve lifter 146. When the bulging portion 143*f* of the deformed cylindrical portion 143*d* comes to the position to raise the damper bucket 147, the damper bucket 147 comes into contact with the outer circumference of the bulging portion 143*f* even with the outer circumference of the cam portion 143*c*, as shown in FIG. 36. At the timing when the side face of the cam portion 143*c* abutting against the damper bucket 147 to block the movement of the free cam lobe 143 disappears, the free cam lobe 143 is slid rightward by the spring 145 and leaves the connector 144 so that it is set free for rotation, and the damper bucket 147 comes into contact with the outer circumference of the cam portion 143*c* of the free cam lobe 143 (as shown in FIG. 37).

Figure 38:
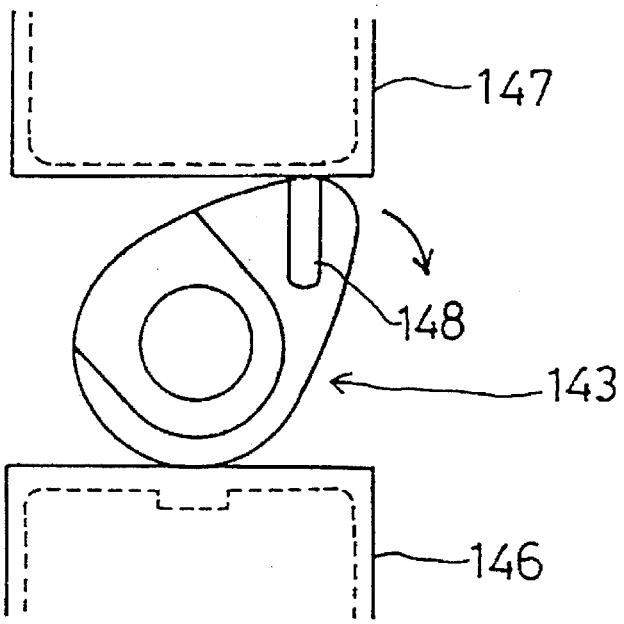
FIG. 38 shows a diagram showing the state in which a turn of 45 degrees is made from the state shown in FIG. 37.

The free cam lobe 143 thus set free for rotation is caused by the inertial force to raise the damper bucket 147 by its cam lobe 143*b*, as shown in FIG. 38. However, the free cam lobe 143 has its rotational energy absorbed by the damper bucket which is urged by a spring and which has an oil pressure chamber formed with an orifice, so that it is pushed back in the opposite direction.

Figure 39:
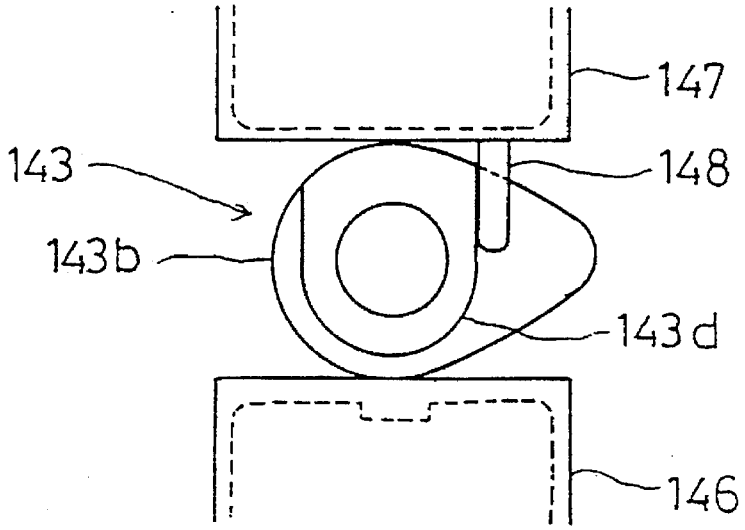
FIG. 39 shows a diagram showing the state in which a reverse turn of 45 degrees is made from the state shown in FIG. 38.
Figure 40:
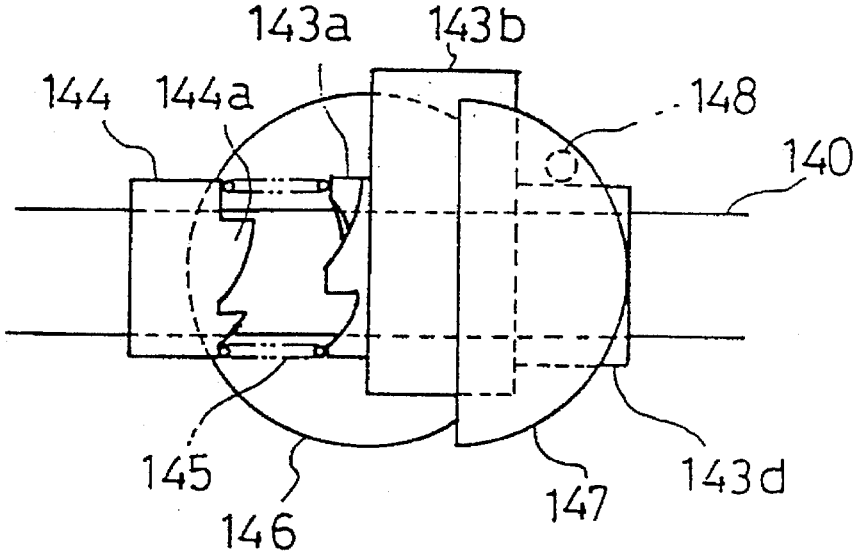
FIG. 40 shows a top plan view of the state shown in FIG. 39.

However, the stopper pin 148 disposed in the damper bucket 147 is protruded along the side face of the cam lobe 143*b* with a displacement equal to the radius of the semi-cylindrical portion 143*e* of the deformed cylindrical portion 143*d* from the center axis of the cam shaft 140, so that the free cam lobe 143 to be reversed, as shown in FIG. 39, is blocked against its reverse rotation by having its deformed cylindrical portion abutting against the stopper pin 148 at its bulging portion 143*f*, so that it is halted. FIG. 40 is a top plan view showing this state.

By not only the mechanism for halting the free cam lobe 143 having been set free for rotation but also the damper bucket 147, according to the present embodiment, the sliding motion of the free cam lobe 143 is temporarily inactivated to set the release to a constant proper timing. As a result, the free cam lobe 143 can be set free for rotation and prevented from rotation at a proper timing independently of the action of the joint pin 141 thereby to improve the activity of the valve.

The drive mechanism of the free cam lobe of the foregoing embodiments has been used to inactivate the valve but can also be used for changing the valve timing.

Specifically, there are provided for one valve the free cam lobe removably fitted on the cam shaft and the rigid cam lobe fixed on the cam shaft. When the free cam lobe having a valve timing different from that of the rigid cam lobe is brought into engagement with the cam shaft, it actuates the valve. When the free cam lobe is disengaged, the rigid cam lobe actuates the valve.

According to the invention, the cam lobe slides in the axial direction of the cam shaft to come into and out of engagement with the cam shaft so that the activity of the valve can be improved while simplifying the structure.

The engagement portion formed on the side face of the cam lobe is brought, when the cam lobe slides, into engagement with the engagement portion of the connector integrated with the cam shaft so that the engagement/disengagement of the cam lobe with/from the cam shaft can be ensured to improve the activity of the valve better in the instant invention.

Moreover, the disengaging timing of the cam lobe from the cam shaft can be set to a proper timing by the disengaging timing adjusting means to halt the rotation of the cam lobe at the most proper rotational phase thereby further improving the activity of the valve.

According to the invention, the relatively light cam lobe slider made rotatable together with the cam shaft by the joint of the joint pin slides the cam lobe in the axial direction so that the joint pin can have its weight reduced and its acting speed raised to drastically improve the activity of the valve.

The cam lobe is also slid in the axial direction by forming a groove having a predetermined shape in the inner circumference of the cam lobe and by threading the joint pin protruded from the cam shaft through the groove, so that the number of parts can be reduced.

In the invention, the cam holding means is equipped with damper means for absorbing the rotational kinetic energy of the cam lobe so that the noise can be reduced to improve durability.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An engine valve drive control device for an engine having a rotatable cam shaft, the cam shaft being rotatably driven by the engine and the control device comprising:

a cam lobe mounted on the cam shaft and selectively being rotated by the cam shaft, the cam lobe being rotated when engaged with the rotating cam shaft to thereby drive a valve of the engine, the cam lobe being slidable in an axial direction with respect to the cam shaft;

cam rotation halting means for stopping rotation of the cam lobe to thereby deactivate the valve, the cam rotation halting means sliding the cam lobe in the axial direction to connect and disconnect the cam lobe from the cam shaft;

a joint pin movably mounted in the cam shaft, the joint pin being extendable from and retractable into the cam shaft, the joint pin extending beyond an outer circumference of the cam shaft when extended therefrom; and a cam lobe slider rotatably fitted on the cam shaft, the cam lobe slider having a joint hole for receiving the joint pin, the joint pin being movable into the joint hole to thereby rotate the cam lobe slider with the cam shaft to slide the cam lobe in the axial direction.

2. The engine valve drive control device as set forth in claim 1, wherein a side of the cam lobe has an engagement portion and the device further comprising a connector, the connector having an engagement portion opposed to the engagement portion of the cam lobe, the connector being integrated with the cam shaft and being engageable with the cam lobe.

3. The engine valve drive control device as set forth in claim 2, further comprising disengagement timing adjusting means for disengaging said cam lobe from said connector by temporarily halting rotation of said cam lobe by sliding the cam lobe axially in a disengaging direction and for releasing the cam lobe to permit resumption of rotation thereof at a predetermined timing.

4. An engine valve drive control device for an engine having a rotatable cam shaft, the cam shaft being rotatably driven by the engine and the control device comprising:

a cam lobe mounted on the cam shaft and selectively being rotated by the cam shaft, the cam lobe being rotated when engaged with the rotating cam shaft to thereby drive a valve of the engine, the cam lobe being slidable in an axial direction with respect to the cam shaft; and cam rotation halting means for stopping inertial rotation of the cam lobe to thereby deactivate the valve before the cam lobe has activated the valve, the cam rotation halting means sliding the cam lobe in the axial direction to connect and disconnect the cam lobe from the cam shaft, said cam rotation halting means including damping means for absorbing rotational kinetic energy of the cam lobe.

5. The engine valve drive control device as set forth in claim 4, wherein a side of the cam lobe has an engagement portion and the device further comprising a connector, the connector having an engagement portion opposed to the engagement portion of the cam lobe, the connector being integrated with the cam shaft and being engageable with the cam lobe.

6. The engine valve drive control device as set forth in claim 5, further comprising disengagement timing adjusting means for disengaging said cam lobe from said connector by temporarily halting rotation of said cam lobe by sliding the cam lobe axially in a disengaging direction and for releasing the cam lobe to permit resumption of rotation thereof at a predetermined timing.

7. An engine valve drive control device for an engine having a rotatable cam shaft, the cam shaft being rotatably driven by the engine and the control device comprising:

a connector rigidly mounted on the cam shaft, the connector being rotatable with the cam shaft;

a cam lobe selectively engageable by the connector;

a joint pin movably mounted in the cam shaft, the joint pin being extendable from and retractable into the cam shaft, the joint pin extending beyond an outer circumference of the cam shaft when extended therefrom;

a cam lobe slider rotatably fitted on the cam shaft, the cam lobe slider having a joint hole for receiving the joint pin, the joint pin being movable into the joint hole to thereby rotate the cam lobe slider with the cam shaft, the cam lobe slider sliding the cam lobe in the axial direction when the joint pin is inserted into the joint hole and the cam lobe slider rotates with the cam shaft, sliding of the cam lobe in the axial direction operatively connecting the cam lobe with the cam shaft such that the cam lobe is rotated therewith, the cam lobe being operatively connected to a valve of the engine such that rotation of the cam lobe drives the valve; and cam rotation halting means for sliding the cam lobe in an axial direction to disconnect the cam lobe from the cam shaft.

8. The engine valve drive control device as set forth in claim 7, wherein at least two cam lobes are provided on the cam shaft, the at least two cam lobes each being operatively connected to a valve of the engine and each cam lobe being axially movable on the cam shaft.

9. The engine valve drive control device as set forth in claim 7, wherein the joint hole has two opposed end portions having a generally semicircular shape and a central portion, the central portion being located between the two opposed end portions, a diameter of each of the end portions being generally equal to a diameter of the joint pin and the central portion having a width which is wider than the diameter of the joint pin.

10. The engine valve drive control device as set forth in claim 7, wherein the joint hole has two opposed end portions and a central portion therebetween, the two end portions having an arcuate shape with an arc thereof being generally equal to a diameter of the joint pin, the arcs of the end portions being smoothly merged into side edges of the central portion, the side edges of the central portion being wider than the diameter of the joint pin.

11. The engine valve drive control device as set forth in claim 7, wherein the cam shaft has an oil passage and a through hole defined therein, the oil passage being connected to the through hole, the joint pin being inserted into the through hole, the joint pin having a transverse hole therein, when oil pressure is applied through the oil passage, the joint pin being extended from the cam shaft to extend beyond the outer circumference of the cam shaft and when oil pressure on the joint pin terminates, the joint pin being retracted into the cam shaft.

12. The engine valve drive control device as set forth in claim 7, wherein said cam lobe is moved in the axial direction along a longitudinal axis of the cam shaft, and wherein:

the connector has a circumferential end face formed with a dowel joint recess, two flat faces generally normal to the longitudinal axis of the cam shaft and a sloped face extending between the two flat faces, the dowel joint recess being located between the two flat faces and being spaced from the sloped face by the two flat faces; and the cam lobe having a first dowel on one circumferential end face and a second dowel on an opposed circumferential end face, the first dowel facing the connector and being received in the dowel joint recess of the connector when the cam lobe is rotating with the cam shaft.

13. The engine valve drive control device as set forth in claim 12, wherein the opposed circumferential end face of the cam lobe having the second dowel further has a cylindrical portion thereon, the cylindrical portion being positioned between the second dowel and a plate cam portion of the cam lobe, the sides of the plate cam portion forming the opposed circumferential end faces of the cam lobe, the cylindrical portion having a notch formed therein, the notch being offset by a predetermined angle from the second dowel, the notch merging into an outer circumference of the cylindrical portion through a sloped face, the cylindrical portion having an inner circumference formed with a second notch of a predetermined shape, the second notch having a constant thickness from the circumferential end face on which the cylindrical portion is mounted, the second notch merging from a slightly inclined arcuate short end face, through a steep end face into a deep end face and then into a gently sloped end face.

14. The engine valve drive control device as set forth in claim 13, wherein the cam lobe slider has two opposed circumferential end faces, the circumferential end face facing the cam lobe having a slight slope portion which merges through a steep end portion into a deep end face portion and then into a gently sloped face portion which is adjacent the slight slope portion, the opposed circumferential end face of the cam lobe slider being formed with portions symmetric to the portions on the end face facing the cam lobe but being offset by 90 degrees in a circumferential direction.

15. The engine valve drive control device as set forth in claim 14, wherein the joint hole is formed in a side wall of the cam lobe slider between the two opposed circumferential end faces.

16. The engine valve drive control device as set forth in claim 14, further comprising a second cam lobe rotatably mounted on the cam shaft, the cam lobe slider being sandwiched between the two cam lobes, both of the cam lobes being axially movable on the cam shaft.

17. The engine valve drive control device as set forth in claim 14, further comprising a rigid cam lobe mounted on the cam shaft, the connector being located between the rigid cam lobe and the first axially slidable cam lobe.

18. The engine valve drive control device as set forth in claim 14, wherein said cam rotation halting means includes damping means for absorbing rotational kinetic energy of the cam lobe.

19. The engine valve drive control device as set forth in claim 5, further comprising:

a joint pin movably mounted in the cam shaft, the joint pin being extendable from and retractable into the cam shaft, the joint pin extending beyond an outer circumference of the cam shaft when extended therefrom; and a cam lobe slider rotatably fitted on the cam shaft, the cam lobe slider having a joint hole for receiving the joint pin, the joint pin being movable into the joint hole to thereby rotate the cam lobe slider with the cam shaft to slide the cam lobe in the axial direction.

* * * * *